US008434197B2

(12) United States Patent
Oshima

(10) Patent No.: US 8,434,197 B2
(45) Date of Patent: May 7, 2013

(54) BIAXIAL HINGE DEVICE

(75) Inventor: Kazuyoshi Oshima, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 13/386,953

(22) PCT Filed: Jul. 23, 2010

(86) PCT No.: PCT/JP2010/004713

§ 371 (c)(1),
(2), (4) Date: Jan. 25, 2012

(87) PCT Pub. No.: WO2011/013335

PCT Pub. Date: Feb. 3, 2011

(65) Prior Publication Data

US 2012/0117757 A1 May 17, 2012

(30) Foreign Application Priority Data

Jul. 30, 2009 (JP) ..... 2009-178213

(51) Int. Cl.
*E05D 15/06* (2006.01)
*E05D 3/06* (2006.01)
*E05D 7/04* (2006.01)

(52) U.S. Cl.
USPC ..... 16/357; 16/366; 16/241; 16/243

(58) Field of Classification Search ..... 16/357, 16/362, 364, 366, 235, 237, 240, 241, 243, 16/245, 355, 356
See application file for complete search history.

(56) References Cited

U.S. PATENT DOCUMENTS

| | | | | | |
|---|---|---|---|---|---|
| 3,881,221 | A * | 5/1975 | Schmidt | 16/366 |
| 4,068,348 | A * | 1/1978 | Chivers | 16/235 |
| 4,727,622 | A * | 3/1988 | Tsuneki | 16/368 |
| 4,738,003 | A * | 4/1988 | Mori et al. | 16/321 |
| 5,561,887 | A * | 10/1996 | Neag et al. | 16/334 |
| 5,685,046 | A * | 11/1997 | Neag et al. | 16/366 |
| 6,243,920 | B1 * | 6/2001 | Sauve | 16/361 |
| 6,829,808 | B2 * | 12/2004 | Neukotter | 16/366 |
| 7,596,831 | B2 * | 10/2009 | Faubert et al. | 16/334 |
| 7,861,378 | B2 * | 1/2011 | Neukotter | 16/366 |
| 8,196,265 | B2 * | 6/2012 | Neukoetter et al. | 16/389 |

FOREIGN PATENT DOCUMENTS

| | | | |
|---|---|---|---|
| JP | 6-288139 | A | 10/1994 |
| JP | 07293097 | A * | 11/1995 |
| JP | 10238198 | A * | 9/1998 |
| JP | 2007-211577 | A | 8/2007 |

OTHER PUBLICATIONS

International Search Report issued in PCT/JP2010/004713, mailed on Sep. 28, 2010, with translation, 2 pages.

* cited by examiner

*Primary Examiner* — Chuck Y. Mah
(74) *Attorney, Agent, or Firm* — Osha Liang LLP

(57) ABSTRACT

One end portion of a front-rear adjustment member 17 is disposed in a door-side mounting member 3 such that the front-rear adjustment member 17 is rotatable about a second shaft 12. An adjustment screw (not shown) having an axis thereof oriented in the left-right direction is provided in the door-side mounting member. The adjustment screw is threadedly engaged with the other end portion of the front-rear adjustment member 17. After the adjustment screw is rotated in normal and reverse directions, thereby rotating the front-rear adjustment member 17 as appropriate, a connecting arm 13 is rotated about a first shaft 11 so as to cancel out the rotation of the front-rear adjustment member 17.

18 Claims, 25 Drawing Sheets

BIAXIAL HINGE DEVICE

FIELD OF THE INVENTION

The present invention relates to a biaxial hinge device for rotatably connecting a door to a frame, and particularly relates to a biaxial hinge device suitable for use as a concealed hinge.

BACKGROUND ART

A biaxial hinge device of this type generally includes a frame-side mounting member, a door-side mounting member and a connecting arm. The frame-side mounting member is disposed in a recess disposed in a side surface of an opening of a frame. The door-side mounting member is disposed in a recess disposed in a side surface of a door. One end portion of the connecting arm is rotatably connected to the frame-side mounting member via a first shaft and the other end portion of the connecting arm is rotatably connected to the door-side mounting member via a second shaft. As a result, the door is rotatably supported by the frame via the biaxial hinge device.

When the door is mounted to the frame via the biaxial hinge device, sometimes a position of the door may be deviated from a normal position due to manufacturing errors and installation errors. In such cases, the position of the door needs to be adjusted in front-rear, left-right and vertical directions. To accommodate this need, in the biaxial hinge device disclosed in the Patent Document 1 given below, the door-side mounting member is mounted to the door such that the position of the door-side mounting member with respect to the door can be adjusted in the front-rear, left-right and vertical directions.

PRIOR ART DOCUMENTS

Patent Documents

Patent Document 1: Japanese Unexamined Patent Application Publication No. 2007-211577.

SUMMARY OF THE INVENTION

Problem to be Solved by the Invention

A door-side mounting member is received in a recess formed in a door. Therefore, to make the door-side mounting member position-adjustable in a vertical direction, it is necessary to make a length of the recess in the vertical direction longer by a length corresponding to an adjustable amount. To make the door-side mounting member position-adjustable in a left-right direction, it is necessary to make a depth of the recess deeper in the left-right direction by a depth corresponding to an adjustable amount. To make the door-side mounting member position-adjustable in a front-rear direction, it is necessary to make a width of the recess wider in the front-rear direction by a width corresponding to an adjustable amount. In such cases, the increase of the length of the recess in the vertical direction and the increase of the depth of the recess may not significantly affect a strength of the door. However, the increase of the width of the recess may reduce a wall thickness between the recess and at least one of a front surface and a rear surface of the door, thereby causing a problem of reduced strength of the door.

Solution to the Problem

To solve the problem described above, a first aspect of the present invention provides a biaxial hinge device comprising:

a frame-side mounting member to be mounted to a frame; a door-side mounting member to be mounted to a door; a connecting arm, one end portion of the connecting arm rotatably connected to the frame-side mounting member via a first shaft, the other end portion of the connecting arm rotatably connected to the door-side mounting member via a second shaft disposed parallel to the first shaft; and a rotation control mechanism, the rotation control mechanism allowing the connecting arm to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft; the door-side mounting member being rotated with respect to the frame-side mounting member between a closed position and an open position by the rotation of the connecting arm about the first shaft and the second shaft, wherein a position adjustment member is disposed in the door-side mounting member such that the position adjustment member is rotatable about a central shaft, the central shaft being one of the second shaft and a shaft disposed parallel to the second shaft; a rotational position adjustment mechanism is disposed between the door-side mounting member and the position adjustment member, the rotational position adjustment mechanism adjusting rotational position of the position adjustment member about the central shaft; and, the rotation control mechanism is disposed between the frame-side mounting member and the position adjustment member on one side and the connecting arm on the other side.

In this case, it is preferable that the second shaft also serves as the central shaft.

Preferably, the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the frame-side mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove; when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

Preferably, when the door-side mounting member is positioned in the closed position, the other end portion of the engagement member is engaged with the second guide groove, the connecting arm being prohibited from rotating about the second shaft, the one end portion of the engagement member is positioned in the other end portion of the first guide groove so that the connecting arm can be rotated about the first shaft in one direction, the other end surface of the first guide groove is spaced from the one end portion of the engagement member by a predetermined distance, and the connecting arm is rotatable about the first shaft in the other direction by an angle corresponding to the distance by which the other end surface of the first guide groove is spaced from the one end portion of the engagement member.

A second aspect of the present invention provides a biaxial hinge device comprising: a frame-side mounting member to be mounted to a frame; a door-side mounting member to be mounted to a door; a connecting arm, one end portion of the connecting arm rotatably connected to the frame-side mounting member via a first shaft, the other end portion of the connecting arm rotatably connected to the door-side mounting member via a second shaft disposed parallel to the first shaft; and a rotation control mechanism, the rotation control mechanism allowing the connecting arm to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft; the door-side mounting member being rotated with respect to the frame-side mounting member between a first rotational position and a second rotational position by the rotation of the connecting arm about the first shaft and the second shaft, wherein a position adjustment member is disposed in the frame-side mounting member such that the position adjustment member is rotatable about a central shaft, the central shaft being one of the first shaft and a shaft disposed parallel to the first shaft; a rotational position adjustment mechanism is disposed between the frame-side mounting member and the position adjustment member, the rotational position adjustment mechanism adjusting rotational position of the position adjustment member about the central shaft; and, the rotation control mechanism is disposed between the door-side mounting member and the position adjustment member on one side and the connecting arm on the other side.

In this case, it is preferable that the first shaft also serves as the central shaft.

Preferably, the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the position adjustment member, one end portion of the engagement member being engaged with the first guide groove such that the one end portion of the engagement member is movable in a longitudinal direction of the first guide groove, the second guide groove being disposed in the door-side mounting member, the other end portion of the engagement member being engaged with the second guide groove such that the other end portion of the engagement member is movable in a longitudinal direction of the second guide groove; when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft; and, when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft.

Preferably, the door-side mounting member is positioned in the closed position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

A third aspect of the present invention provides a biaxial hinge device comprising: a first mounting member; a second mounting member; a connecting arm, one end portion of the connecting arm connected to the first mounting member such that the connecting arm is rotatable about a first shaft, the other end portion of the connecting arm connected to the second mounting member such that the connecting arm is rotatable about a second shaft disposed parallel to the first shaft; and a rotation control mechanism, the rotation control mechanism allowing the connecting arm to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft; the second mounting member being rotated with respect to the first mounting member between a first rotational position and a second rotational position by the rotation of the connecting arm about the first shaft and the second shaft, wherein a position adjustment member is disposed in the second mounting member such that the position adjustment member is rotatable about a central shaft, the central shaft being one of the second shaft and a shaft disposed parallel to the second shaft; a rotational position adjustment mechanism is disposed between the second mounting member and the position adjustment member, the rotational position adjustment mechanism adjusting a rotational position of the position adjustment member with respect to the second mounting member; and, the rotation control mechanism is disposed between the first mounting member and the position adjustment member on one side and the connecting arm on the other side.

In this case, it is preferable that the second shaft also serves as the central shaft.

Preferably, the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the first mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove; when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

Preferably, when the second mounting member is positioned in the first rotational position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

Advantageous Effects of the Invention

In the first aspect of the present invention, to adjust the position of the door-side mounting member (door) with respect to the frame-side mounting member in the direction orthogonal to the second shaft, the hinge device is first brought to a condition in which the rotation of the connecting arm about the second shaft is prohibited by the rotation control mechanism. In other words, the hinge device is brought to a condition in which the rotations of the position adjustment member and the connecting arm about the second shaft are prohibited. Next, the position adjustment member is rotated by the rotational position adjustment mechanism by an appropriate angle with respect to the door-side mounting member. This causes the door-side mounting member to be rotated about the central shaft with respect to the connecting arm. This is because the rotation of the position adjustment member with respect to the connecting arm is prohibited by the rotation control mechanism. The rotation of the door-side mounting member causes an attitude (rotational attitude) of the door-side mounting member (door) with respect to the frame-side mounting member (frame) to be changed. Then, the connecting arm is rotated about the first shaft with respect to the frame-side mounting member. At this time, the connecting arm is rotated such that the rotational attitude of the door-side mounting member with respect to the frame-side mounting member returns to the rotational attitude that was assumed by the door-side mounting member before the position adjustment member was rotated. When the position adjustment member and the door-side mounting member are rotated in this manner, the position of the door-side mounting member with respect to the frame-side mounting member is adjusted by a distance corresponding to the rotated angle in the direction orthogonal to the second shaft.

In the second aspect of the present invention, to adjust the position of the door-side mounting member (door) with respect to the frame-side mounting member in the direction orthogonal to the first shaft, the hinge device is first brought to a condition in which the rotation of the connecting arm about the first shaft is prohibited by the rotation control mechanism. In other words, the hinge device is brought to a condition in which the rotations of the position adjustment member and the connecting arm about the first shaft are prohibited. Next, the position adjustment member is rotated by the rotational position adjustment mechanism by an appropriate angle with respect to the frame-side mounting member. This causes the frame-side mounting member to be rotated about the central shaft with respect to the connecting arm. This is because the rotation of the position adjustment member with respect to the connecting arm is prohibited by the rotation control mechanism. The rotation of the frame-side mounting member causes an attitude (rotational attitude) of the door-side mounting member (door) with respect to the frame-side mounting member (frame) to be changed. Then, the door-side mounting member is rotated about the second shaft with respect to the connecting arm. At this time, the door-side mounting member is rotated such that the rotational attitude of the door-side mounting member with respect to the frame-side mounting member returns to the attitude before the position adjustment member is rotated. When the position adjustment member and the door-side mounting member are rotated in this manner, the position of the door-side mounting member with respect to the frame-side mounting member is adjusted by a distance corresponding to the rotated angle in the direction orthogonal to the first shaft.

In the third aspect of the present invention, to adjust the position of the second mounting member with respect to the first mounting member in the direction orthogonal to the second shaft, the hinge device is first brought to a condition in which the rotation of the connecting arm about the second shaft is prohibited by the rotation control mechanism. In other words, the hinge device is brought to a condition in which the rotations of the position adjustment member and the connecting arm about the second shaft are prohibited. Next, the position adjustment member is rotated by the rotational position adjustment mechanism by an appropriate angle with respect to the second mounting member. This causes the second mounting member to be rotated about the central shaft with respect to the connecting arm. This is because the rotation of the position adjustment member with respect to the connecting arm is prohibited by the rotation control mechanism. The rotation of the second mounting member causes an attitude (rotational attitude) of the second mounting member with respect to the first mounting member to be changed. Then, the connecting arm is rotated about the first shaft with respect to the first mounting member. At this time, the connecting arm is rotated such that the rotational attitude of the second mounting member with respect to the first mounting member returns to the attitude before the position adjustment member is rotated. When the position adjustment member and the second mounting member are rotated in this manner, the position of the second mounting member with respect to the first mounting member is adjusted by a distance corresponding to the rotated angle in the direction orthogonal to the second shaft.

DESCRIPTION OF THE PREFERRED EMBODIMENTS

Figure 1:
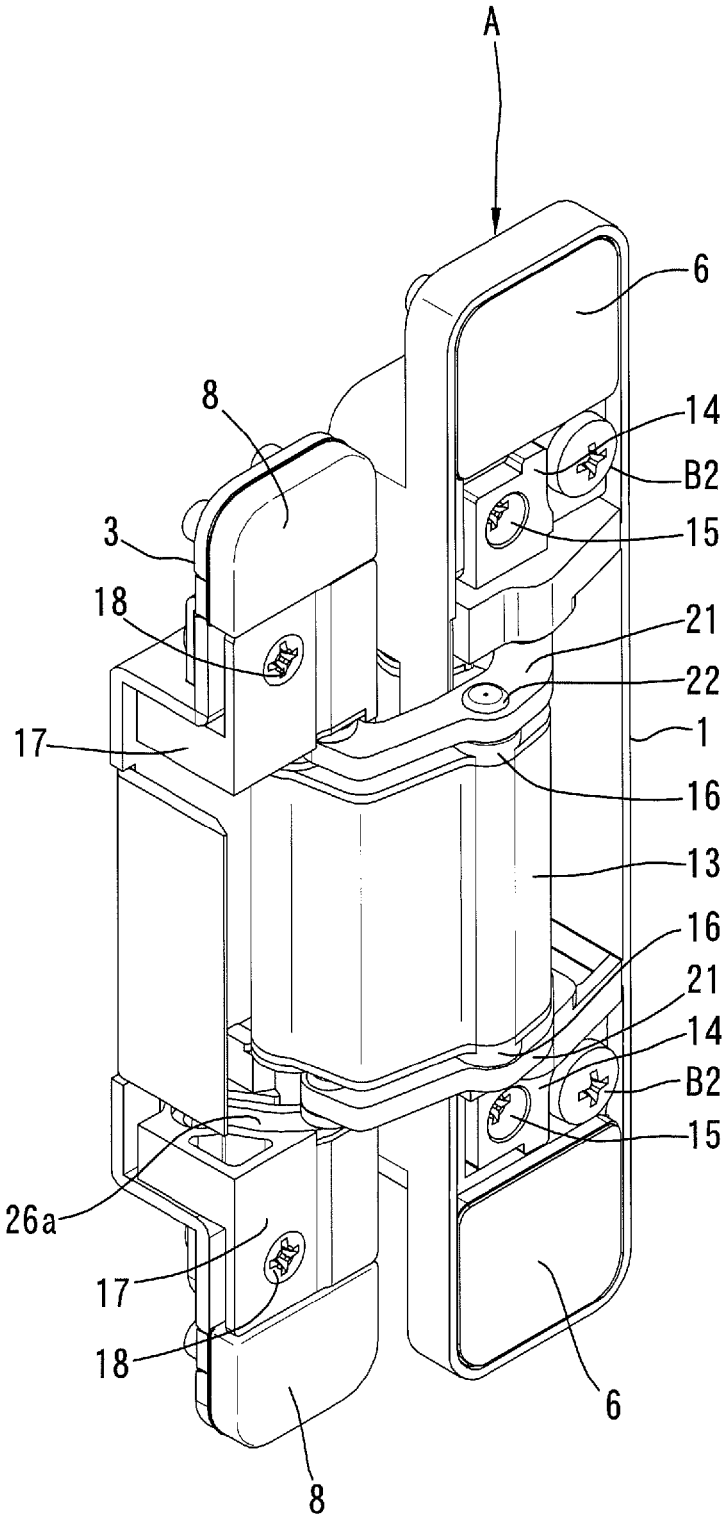
FIG. 1 is a perspective view of a first embodiment of a biaxial hinge device according to the present invention, with a door-side mounting member positioned in an open position.
Figure 2:
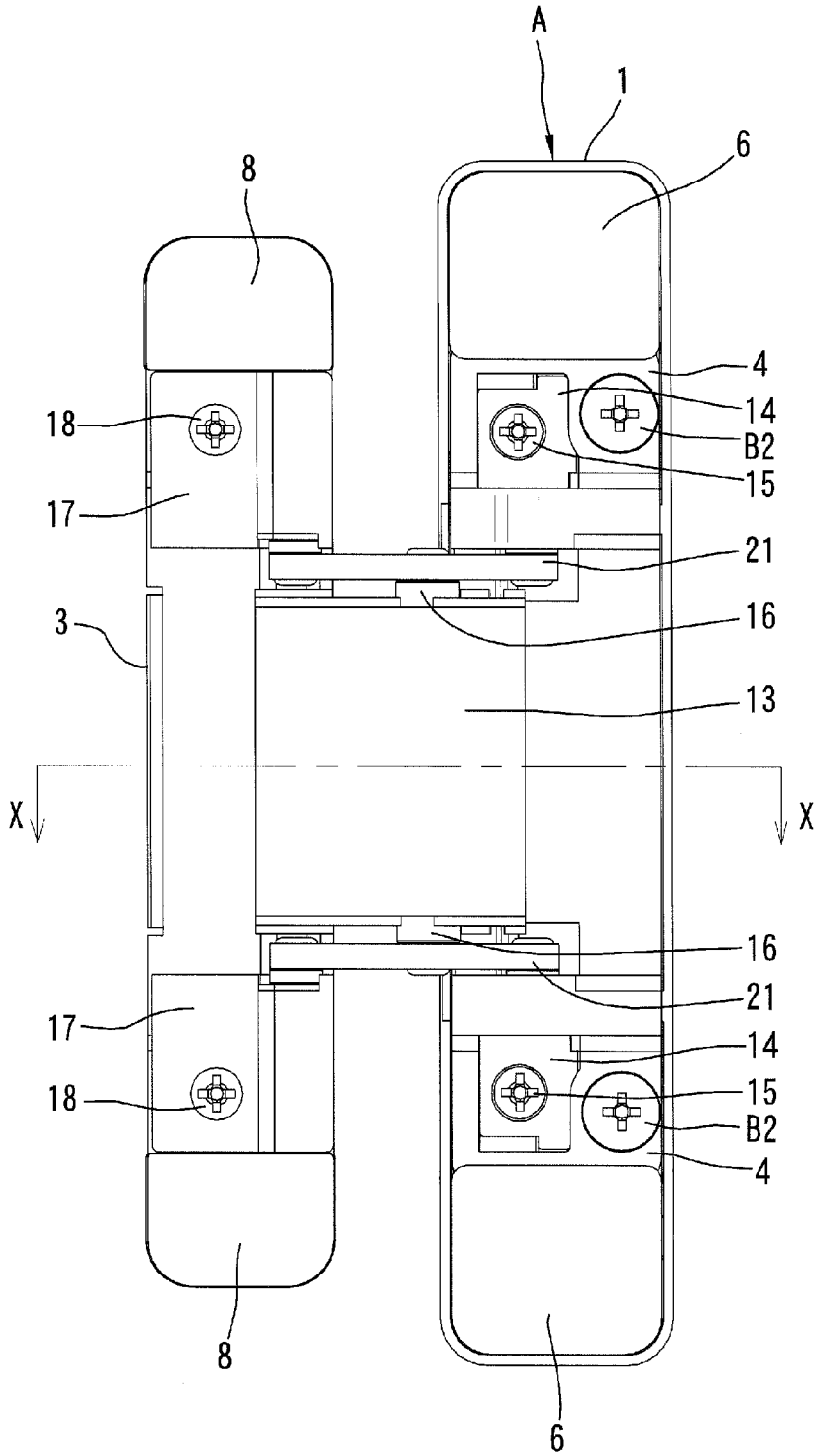
FIG. 2 is a front view of the first embodiment of the biaxial hinge device according to the present invention, with the door-side mounting member positioned in the open position.
Figure 3:
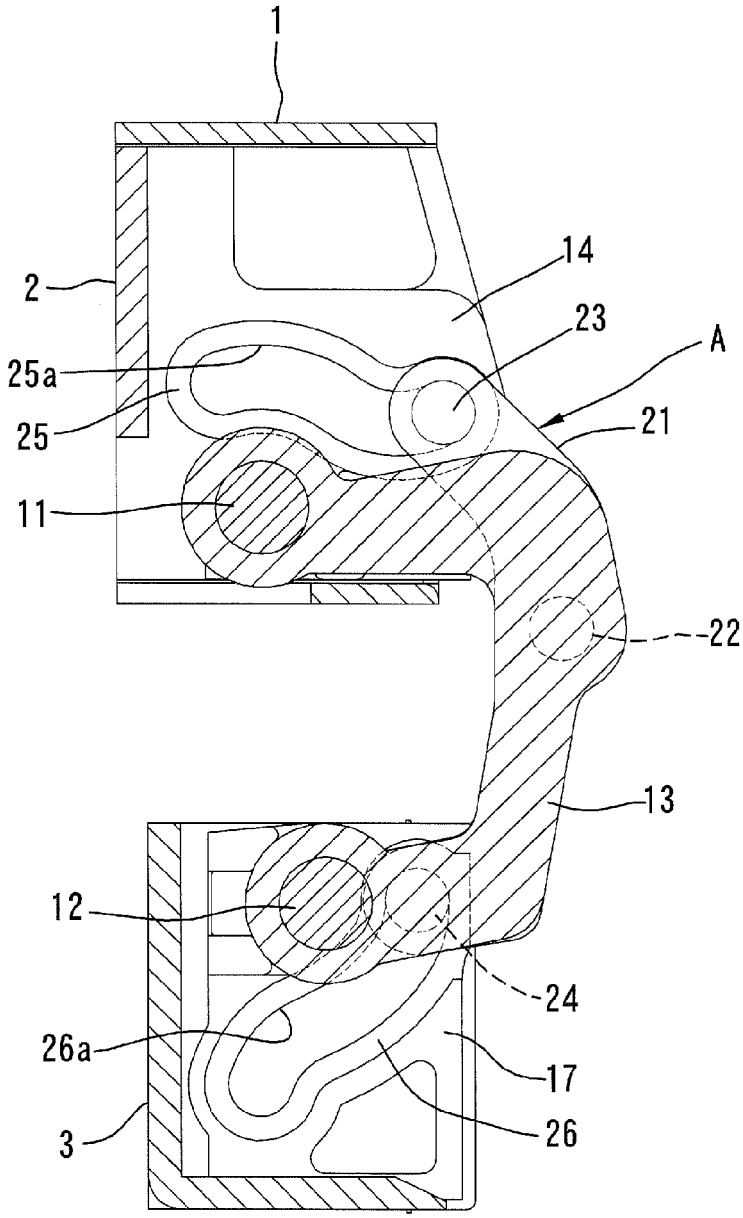
FIG. 3 is an enlarged cross-sectional view along line X-X of FIG. 2.
Figure 4:
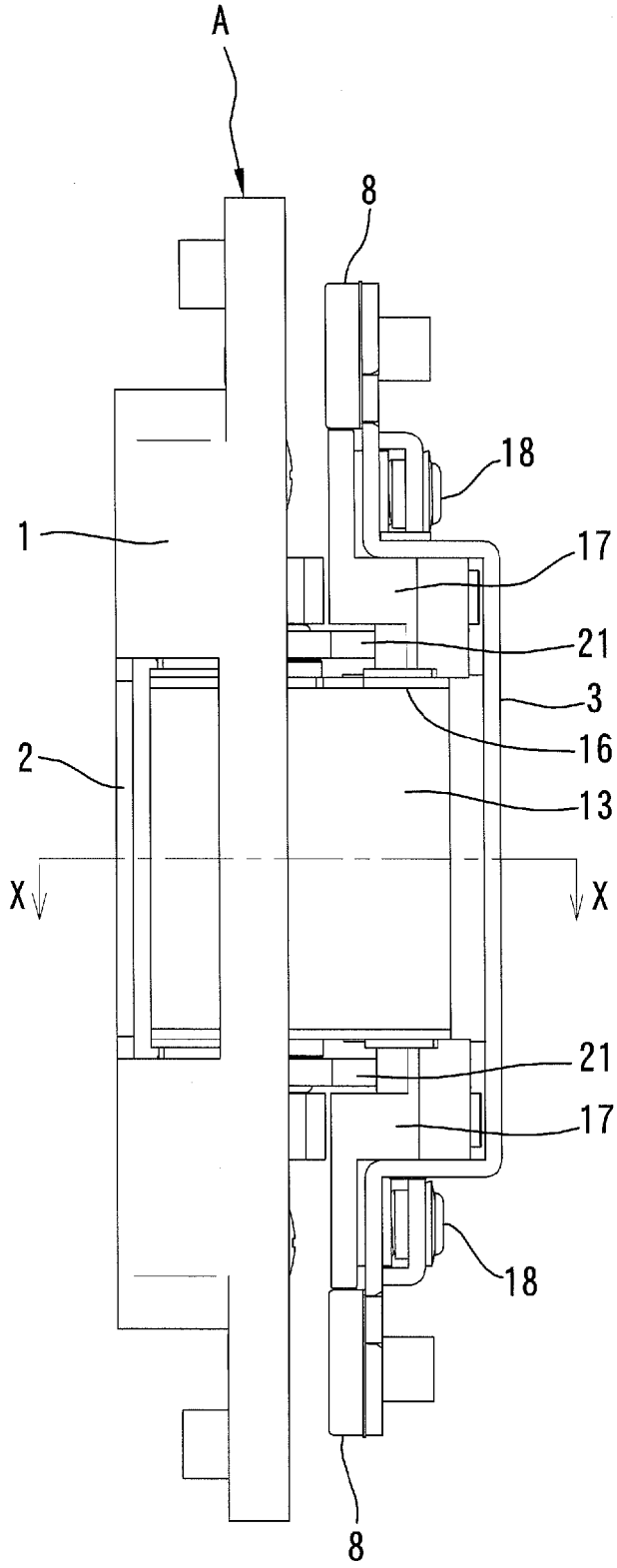
FIG. 4 is a side view of the first embodiment of the biaxial hinge device according to the present invention, with the door-side mounting member positioned in a closed position.

A best mode for carrying out the invention will be described hereinafter with reference to the drawings.

FIGS. 1 to 6 show only a biaxial hinge device A according to the present invention. FIGS. 7 to 11 show the biaxial hinge device A disposed between a frame B and a door C. The frame B and the door C will be described first with reference to FIGS. 7 to 11. The frame B has an opening Ba having a generally quadrangular configuration. A first receiving recess Bb is disposed in an inner surface of one side portion of the frame B in a left-right direction. The inner surface faces the opening Ba. The first receiving recess Bb is oriented such that a longitudinal direction of the first receiving recess Bb is oriented in a vertical direction and a width direction of the first receiving recess Bb is oriented in a front-rear direction. The door C is provided for opening and closing the opening Ba. The door C is supported by the frame B via the biaxial hinge device A such that the door C can be rotated to open and close the opening Ba in a horizontal direction. The door C can be rotated between a closed position (first rotational position) shown in FIG. 7 and an open position (second rotational position) shown in FIG. 11. In the closed position, the door C is located inside the opening Ba, thereby closing the opening Ba. The open position is spaced from the closed position by about 180 degrees. A second receiving recess Ca is formed in one side surface of the door C. The second receiving recess Ca is oriented such that a longitudinal direction of the second receiving recess Ca is oriented in the vertical direction and a width direction of the second receiving recess Ca is oriented in the front-rear direction when the door C is positioned in the closed position. Moreover, the second receiving recess Ca is oriented such that the second receiving recess Ca is opposed to the first receiving recess Bb when the door C is positioned in the closed position. In this embodiment, when the door C is positioned in the closed position, a front surface Bc of the frame B and a front surface Cb of the door C are positioned coplanar with each other, i.e., in the same position in the front-rear direction.

The biaxial hinge device A for rotatably connecting the door C to the frame B will be described now. The biaxial hinge device A is configured vertically symmetrically with respect to a bisector that bisects the biaxial hinge device A into upper and lower halves. Therefore, in the description hereinafter, features of an upper half of the biaxial hinge device A only will be described. Description of a lower half of the biaxial hinge device A will be omitted, with components similar to those in the upper half referred to by the same reference numerals. Front-rear and left-right directions of components related to a door-side mounting member 3 refer to the front-rear and left-right directions when the door C is positioned in the closed position.

As shown in FIGS. 1 to 6, the biaxial hinge device A includes a fixed member 1, a frame-side mounting member (first mounting member) 2 and the door-side mounting member (second mounting member) 3. The fixed member 1 is formed of a hard resin and is disposed in the first receiving recess Bb. A reinforcement panel 4 is fixed by a pin 5 in an upper end portion of the fixed member 1. A bolt B1 is disposed through the reinforcement panel 4. The bolt B1 is threadedly engaged with the frame B through the fixed member 1. By screwing up the bolt B1, the upper end portion of the fixed member 1 is fixed to a bottom surface of the first receiving recess Bb of the frame B, and furthermore, the reinforcement panel 4 is fixed to the fixed member 1. An eccentric shaft 7, a longitudinal direction of which is oriented in the left-right direction, is disposed in the reinforcement panel 4 such that the eccentric shaft 7 is rotatable but fixed in position. The bolt B1 is covered with a decorative panel 6 mounted in the upper end portion of the fixed member 1 so that the bolt B1 can not be viewed from outside.

The frame-side mounting member 2 is made of a metal plate. The frame-side mounting member 2 is disposed in the fixed member 1 such that a position of the frame-side mounting member 2 can be adjusted in a predetermined range in the vertical direction. More specifically, an abutment surface 2*a* facing downward is formed in an upper end portion of the frame-side mounting member 2. The abutment surface 2*a* is abutted against an upper surface of an eccentric portion of the eccentric shaft 7 by a self-weight of the frame-side mounting member 2. Accordingly, when the eccentric shaft 7 is appropriately rotated within a range of 180 degrees, the position of the frame-side mounting member 2 is adjusted in the vertical direction against the self-weight of the frame-side mounting member 2. As a result, the position of the door C with respect to the frame B is adjusted in the vertical direction as will be described later. After the position adjustment, the frame-side mounting member 2 is fixed to the reinforcement plate 4 by screwing up a bolt B2 threadedly engaged with a screw hole 4*a* of the reinforcement plate 4 through an elongated hole 2*b* disposed in the upper end portion of the frame-side mounting member 2, and consequently, the frame-side mounting member 2 is fixed to the frame B. The bolt B2 is also covered with the decorative panel 6.

The door-side mounting member 3 is made of a metal plate and is disposed in the second receiving recess Ca of the door C. An upper end portion of the door-side mounting member 3 is fixed to a bottom surface of the second receiving recess Ca by screwing up a bolt B3 threadedly engaged with the door C through the upper end portion of the door-side mounting member 3. The bolt B3 is covered with a decorative panel 8 mounted in the upper end portion of the door-side mounting member 3 so that the bolt B3 can not be viewed from outside.

The frame-side mounting member 2 and the door-side mounting member 3 are rotatably connected to each other via mainly a first shaft 11, a second shaft 12 and a connecting arm 13. More specifically, a left-right adjustment member 14 is disposed in the upper end portion of the frame-side mounting member 2 such that the left-right adjustment member 14 is movable in the left-right direction (direction in which the frame B and the door C are opposed when the door C is positioned in the closed position: left-right direction in FIG. 7). The left-right adjustment member 14 is movable only in the left-right direction with respect to the frame-side mounting member 2, and the left-right adjustment member 14 is not movable in the other directions. An adjustment screw 15 having an axis thereof oriented in the left-right direction is threadedly engaged through the left-right adjustment member 14. A basal end portion of the adjustment screw 15 that is passed through the left-right adjustment member 14 is disposed in the frame-side mounting member 2 such that the adjustment screw 15 is rotatable but fixed in position. Therefore, when the adjustment screw 15 is rotated in normal and reverse directions, the position of the left-right adjustment member 14 is adjusted in the left-right direction. As a result, the position of the door C is adjusted in the left-right direction as will be described later.

Upper and lower end portions of the first shaft 11 having an axis thereof oriented in the vertical direction are respectively non-movably supported by the upper and lower left-right adjustment members 14, 14. A middle portion of the first shaft 11 is rotatably disposed through one end portion of the connecting arm 13 via an antifriction member 16 made of resin. By this arrangement, the one end portion of the connecting member 13 is rotatably attached to the frame-side mounting member 2 via the first shaft 11. Moreover, upper and lower end surfaces of the connecting arm 13 respectively contact the upper and lower left-right adjustment members 14, 14. Accordingly, the connecting arm 13 is not movable in the vertical direction with respect to the frame-side mounting member 2. In this manner, the one end portion of the connecting arm 13 is attached to the frame-side mounting member 2 such that the connecting arm 13 is rotatable but non-movable in the vertical direction and the front-rear direction (vertical direction in FIG. 7) but position-adjustable in the left-right direction.

Upper and lower end portions of the second shaft 12 having an axis thereof oriented in the vertical direction are respectively non-movably supported by the upper and lower end portions of the door-side mounting member 3. A middle portion of the second shaft 12 is rotatably disposed through the other end portion of the connecting arm 13 via the antifriction member 16. In this manner, the other end portion of the connecting member 13 is rotatably attached to the door-side mounting member 3 via the second shaft 12. Moreover, the upper and lower end surfaces of the connecting arm 13 respectively contact front-rear adjustment members (position adjustment members) 17, 17 to be described later. Accordingly, the connecting arm 13 is not movable in the vertical direction with respect to the door-side mounting member 3. In this manner, the other end portion of the connecting arm 13 is attached to the door-side mounting member 3 such that the connecting arm 13 is rotatable but non-movable in the vertical direction, the left-right direction and the front-rear direction.

The front-rear adjustment member 17 is disposed in the upper end portion of the door-side mounting member 3. The second shaft 12 is rotatably disposed through one end portion of the front-rear adjustment member 17. An adjustment screw 18 having an axis thereof oriented in the left-right direction is threadedly engaged through the other end portion of the front-rear adjustment member 17. A basal end portion of the adjustment screw 18 that is passed through the front-rear adjustment member 17 is disposed in the door-side mounting member 3 such that the adjustment screw 18 is rotatable but non-movable in the left-right direction. Therefore, when the adjustment screw 18 is rotated in normal and reverse directions, the front-rear adjustment member 17 is rotated about the second shaft 12 with respect to the door-side mounting member 3. When the front-rear adjustment member 17 is rotated about the second shaft 12, a threaded engagement portion at which the adjustment screw 18 is threadedly engaged with the front-rear adjustment member 17 is moved in the front-rear direction. Therefore, it is desirable that the basal end portion of the adjustment screw 18 is connected to the door-side mounting member 3 such that the adjustment screw 18 is movable in the front-rear direction. However, since an amount of movement of the threaded engagement portion in the front-rear direction is very small, it is acceptable that the adjustment screw 18 is disposed such that the adjustment screw 18 is not movable with respect to the door-side mounting member 3 in the front-rear direction.

The upper and lower front-rear adjustment members 17, 17 respectively contact the upper and lower end surfaces of the connecting arm 13 via the antifriction members 16, 16. The front-rear adjustment members 17, 17 and the connecting arm 13 are generally held by the door-side mounting member 3 from above and below. Accordingly, the front-rear adjustment members 17, 17 and the connecting arm 13 are non-movable with respect to the door-side mounting member 3 in the vertical direction.

The one end portion of the connecting arm 13 is rotatably attached to the frame-side mounting member 2 and the other end portion of the connecting arm 13 is rotatably attached to the door-side mounting member 3. As a result, the door-side mounting member 3 is rotatably connected to the frame-side mounting member 2 via the first shat 11, the second shaft 12 and the connecting arm 13, and consequently, the door C is rotatably supported by the frame B.

When the door C is rotated from the closed position to the open position, at first, the connecting arm 13 alone is rotated about the first shaft 11 by a predetermined angle. Then, the connecting arm 13 is rotated about the first shaft 11 by a predetermined angle toward the open position, and at the same time, the door-side mounting member 3 is rotated about the second shaft 12 with respect to the connecting arm 13 by a predetermined angle toward the open position. After that, the door-side mounting member 3 alone is rotated about the second shaft 12 by a predetermined angle. As a result, the door C reaches the open position from the closed position. Reversely, when the door C is rotated from the open position to the closed position, at first, the door-side mounting member 3 alone is rotated about the second shaft 12 with respect to the connecting arm 13 by a predetermined angle. Then, the door-side mounting member 3 is rotated about the second shaft 12 by a predetermined angle, and at the same time, the connecting arm 13 is rotated about the first shaft 11 with respect to the frame-side mounting member 2 by a predetermined angle. After that, the connecting arm 13 alone is rotated about the first shaft 11 by a predetermined angle. As a result, the door C reaches the closed position from the open position.

To rotate the connecting arm 13 and the door-side mounting member 3 with respect to the frame-side mounting member 2 in the manner described above, a rotation control mechanism 20 is disposed between the frame-side mounting member 2 and the door-side mounting member 3 on one side and the connecting arm 13 on the other side. A principled structure and actions of the rotation control mechanism 20 are similar to those of rotation control mechanisms used in well-known biaxial hinge devices. The rotation control mechanism 20 is described below.

The rotation control mechanism 20 includes a swingable member (engagement member) 21. The swingable member 21 swingably contacts the upper end surface of the connecting arm 13 via the antifriction member 16. A middle portion of the swingable member 21 is disposed in an upper end portion of the connecting arm 13 via a shaft 22 having an axis thereof oriented in the vertical direction, such that the swingable member 21 is swingable in the horizontal direction. A first engagement shaft 23 and a second engagement shaft 24 having respective axes thereof oriented in the vertical direction are respectively disposed in opposite end portions of the swingable member 21.

Figure 5:
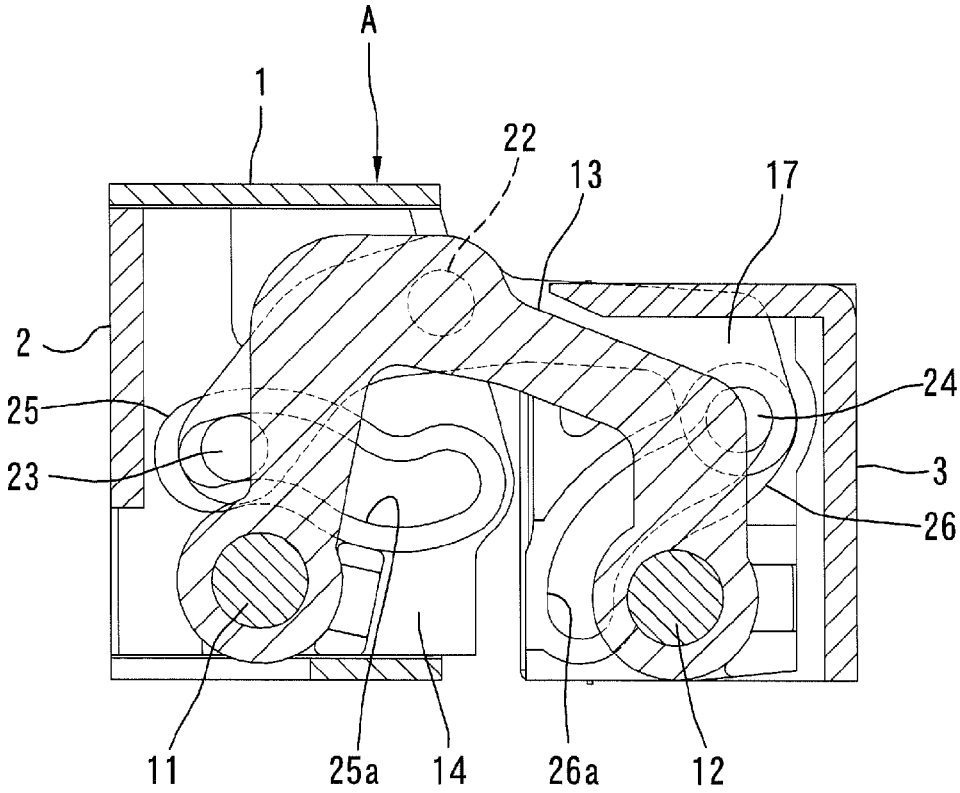
FIG. 5 is an enlarged cross-sectional view along line X-X of FIG. 4.
Figure 6:
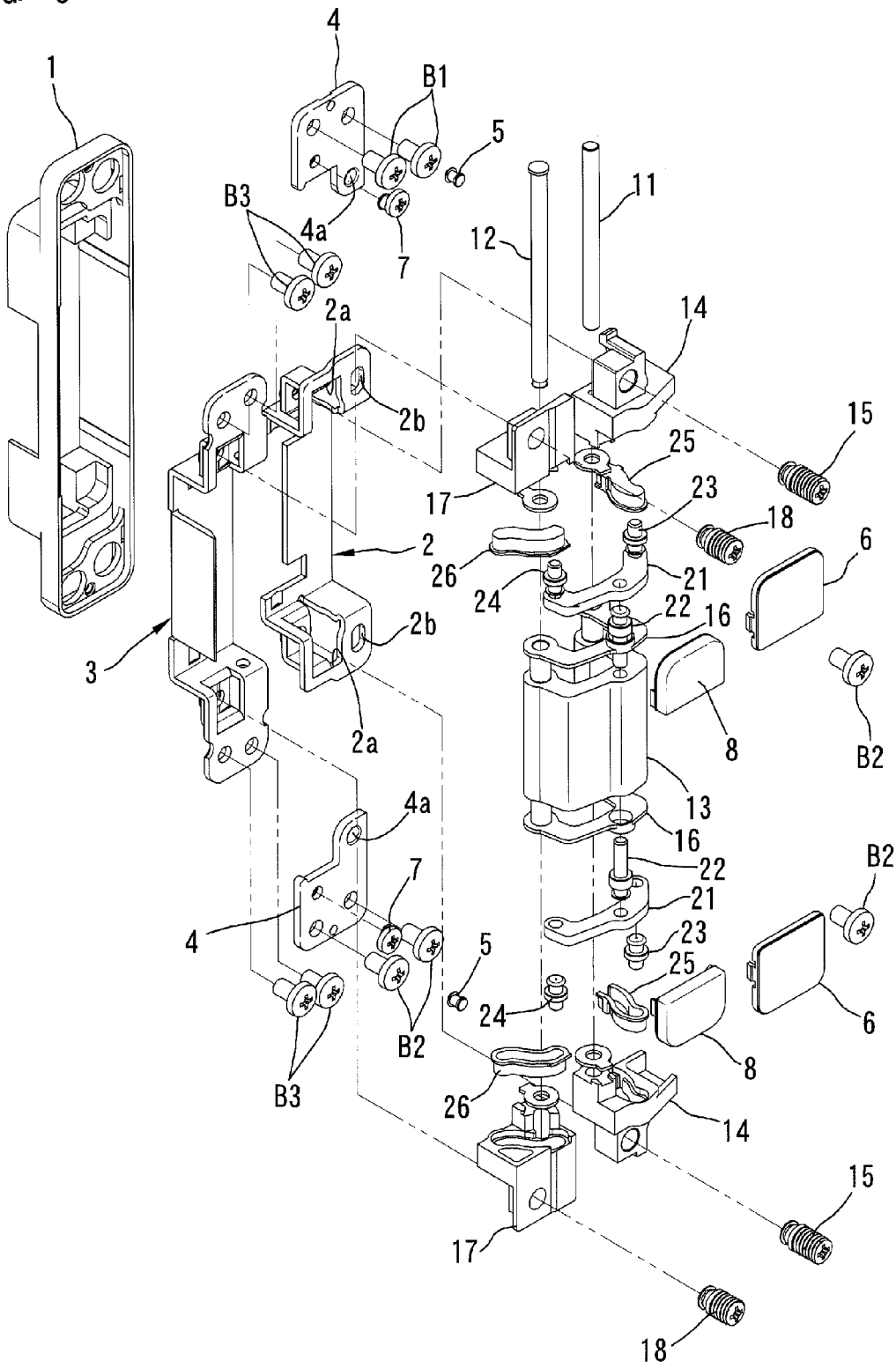
FIG. 6 is an exploded perspective view of the first embodiment of the biaxial hinge device according to the present invention.

A first guide member 25 is disposed in an under surface of the left-right adjustment member 14. As shown in FIG. 5, a first guide groove 25*a* is formed in an under surface of the first guide member 25. The first engagement shaft (one end portion of an engagement member) 23 is disposed in the first guide groove 25*a* such that the first engagement shaft 23 can be moved along a longitudinal direction of the first guide groove 25*a*.

A second guide member 26 is disposed in an under surface of the front-rear adjustment member 17. A second guide groove 26*a* is formed in an under surface of the second guide member 26. The second engagement shaft (the other end portion of the engagement member) 24 is disposed in the second guide groove 26*a* such that the second engagement shaft 24 can be moved along a longitudinal direction of the second guide groove 26*a*.

Figure 7:
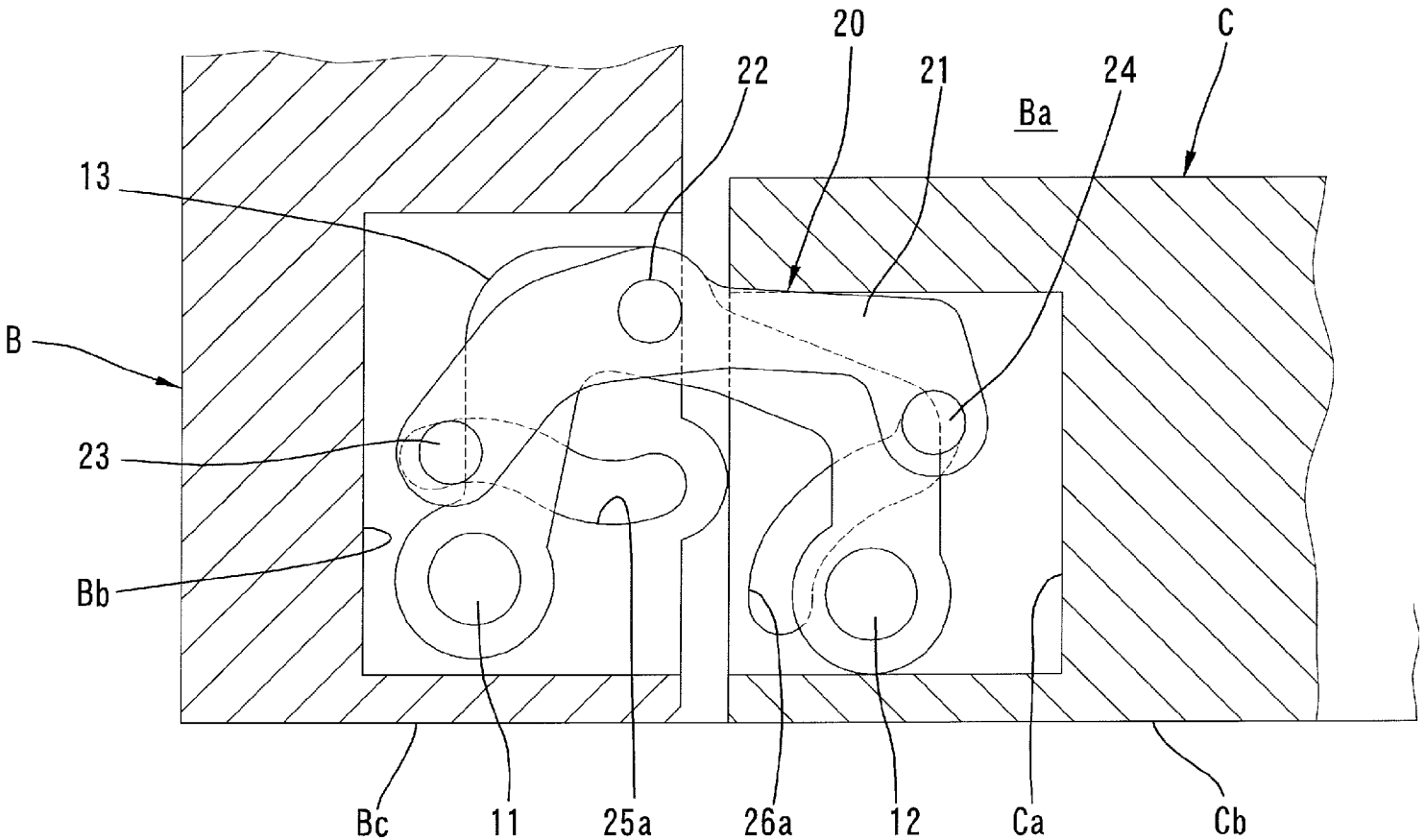
FIG. 7 is a plan view of a rotation control mechanism according to the first embodiment of the present invention in a condition when a door is positioned in a closed position.

As shown in FIG. 7, when the door C is positioned in the closed position, the first engagement shaft 23 is positioned in one end portion (left end portion in FIG. 7; the other end portion) of the first guide groove 25*a* and the second engagement shaft 24 is positioned in one end portion (right end portion in FIG. 7) of the second guide groove 26*a*. At this time, the first engagement shaft 23 is slightly spaced from one end surface (the other end surface) of the first guide groove 25*a* toward the other end (toward one end). Therefore, when the door C is positioned in the closed position, the first engagement shaft 23 can be slightly moved in a direction from the other end toward the one end of the first guide groove 25*a* as well as the first engagement shaft 23 can be moved toward the other end of the first guide groove 25*a*. The second engagement shaft 24 is slightly spaced from one end surface of the second guide groove 26*a* toward the other end of the second guide groove 26*a*. Therefore, when the door C is positioned in the closed position, the second engagement shaft 24 can be slightly moved in a direction from the other end toward the one end of the second guide groove 26*a* as well as the second engagement shaft 24 can be moved toward the other end of the second guide groove 26*a*.

In a condition where the door C is positioned in the closed position, when the connecting arm 13 is rotated in a clockwise direction (to be referred to as an opening direction hereinafter) of FIG. 7 about the first shaft 11 in order to rotate the door C toward the open position, the first engagement shaft 23 is moved in the first guide groove 25*a* toward the other end of the first guide groove 25*a*. Therefore, when the door C is positioned in the closed position, the connecting arm 13 can be rotated about the first shaft 11 in the opening direction (one direction) with respect to the frame-side mounting member 2. On the other hand, when the door C is rotated from the closed position toward the open position, the second engagement shaft 24 is slightly moved in the second guide groove 26*a* from the other end side toward the one end of the second guide groove 26*a* and engages the one end portion of the second guide groove 26*a*. As a result, the door C (door-side mounting member 3) is prohibited from being rotated about the second shaft 12 in the opening direction with respect to the connecting arm 13. Therefore, when the door C is to be rotated from the closed position toward the open position, at first only the connecting arm 13 is rotated about the first shaft 11 in the opening direction, thereby causing the door C to be rotated in the opening direction.

When the door C is rotated in the opening direction up to a first angular position spaced from the closed position by a predetermined first angle (60 degrees, for example) and the first engagement shaft 23 reaches a position a predetermined distance before the other end edge of the first guide groove 25*a*. From then on, the first engagement shaft 23 is moved in the first guide groove 25*a* further toward the other end along with the rotation of the connecting arm 13 in the opening direction. This causes the swingable member 21 to be rotated about the shaft 22 in the clockwise direction in FIG. 8. This causes the second engagement shaft 24 to be moved in the second guide groove 26*a* from the one end portion toward the other end of the second guide groove 26*a*. Accordingly, when the door C is rotated beyond the first angular position, the connecting arm 13 is rotated about the first shaft 11 in the opening direction, and at the same time, the door-side mounting member 3 is rotated about the second shaft 12 in the opening direction. This causes the door C to be rotated further toward the open position.

Figure 9:
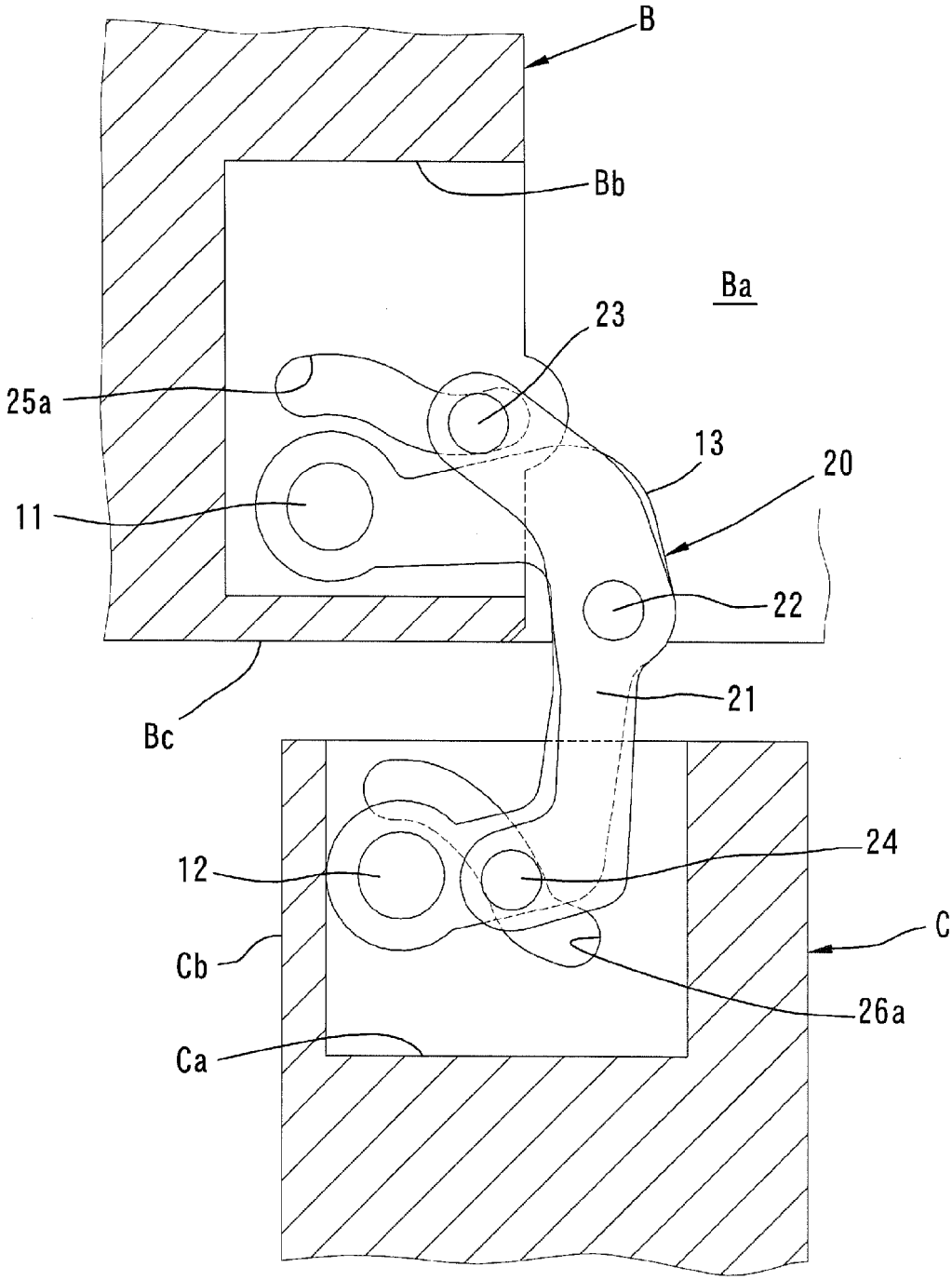
FIG. 9 is a plan view of the rotation control mechanism in a condition when the door is rotated by 90 degrees from the closed position toward the open position.
Figure 10:
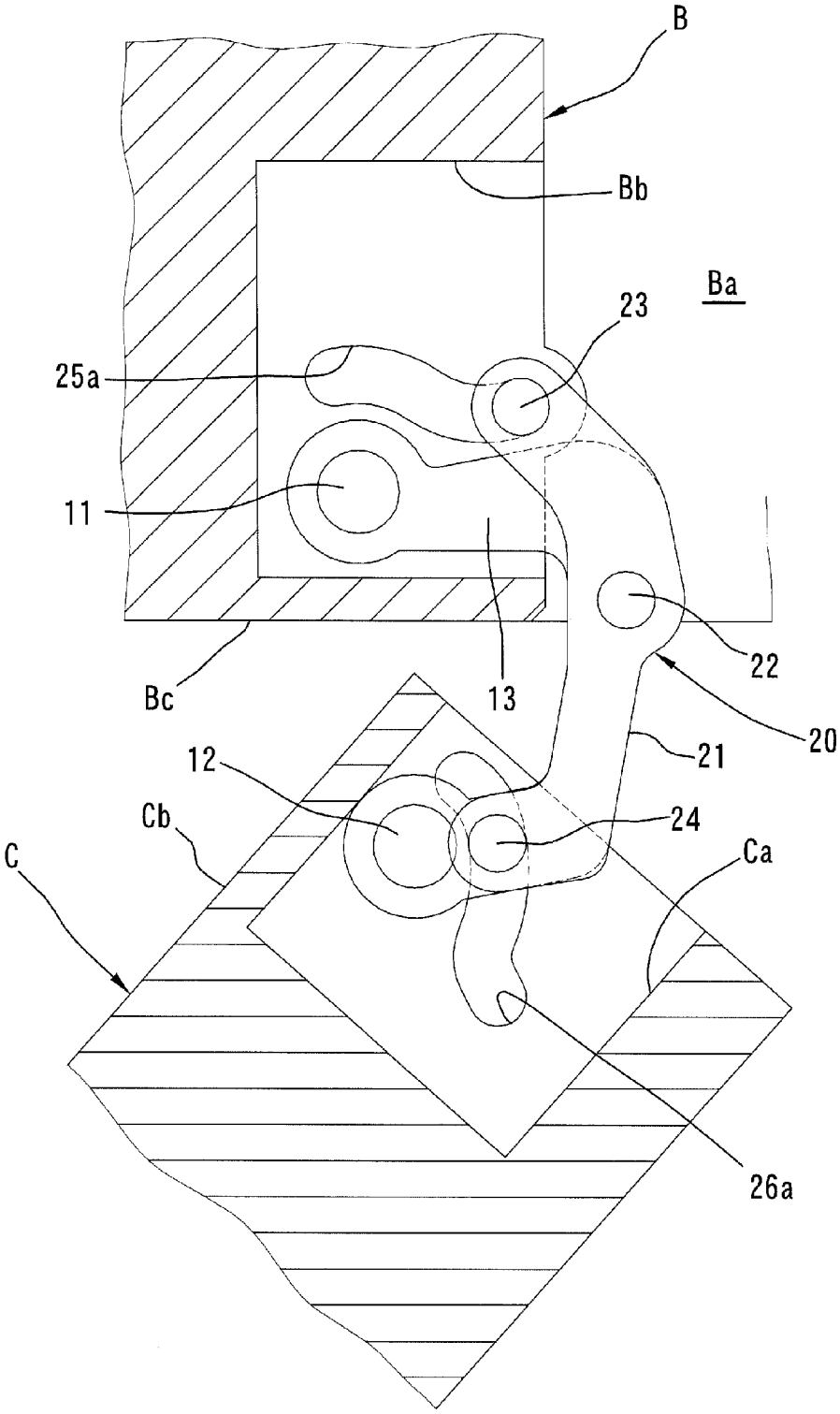
FIG. 10 is a plan view of the rotation control mechanism in a condition when the door is rotated by a predetermined angle that is greater than 90 degrees from the closed position toward the open position.

When the door C is rotated from the closed position by a predetermined second angle (120 degrees, for example) that is greater than the first angle, i.e., when the door C is rotated beyond the 90 degrees position shown in FIG. 9 and reaches a second angular position shown in FIG. 10, the first engagement shaft 23 is abutted against the other end portion (one end portion) of the first guide groove 25*a*. As a result, the swingable member 21 is prohibited from being rotated further in the clockwise direction. In this condition, the swingable member 21 prohibits the connecting arm 13 from being rotated about the first shaft 11 in the opening direction. Therefore, after the door C reaches the second angular position, only the door-side mounting member 3 is rotated about the second shaft 12 in the opening direction with respect to the connecting arm 13, and the door C is rotated in the opening direction following the rotation of the door-side mounting member 3.

Figure 11:
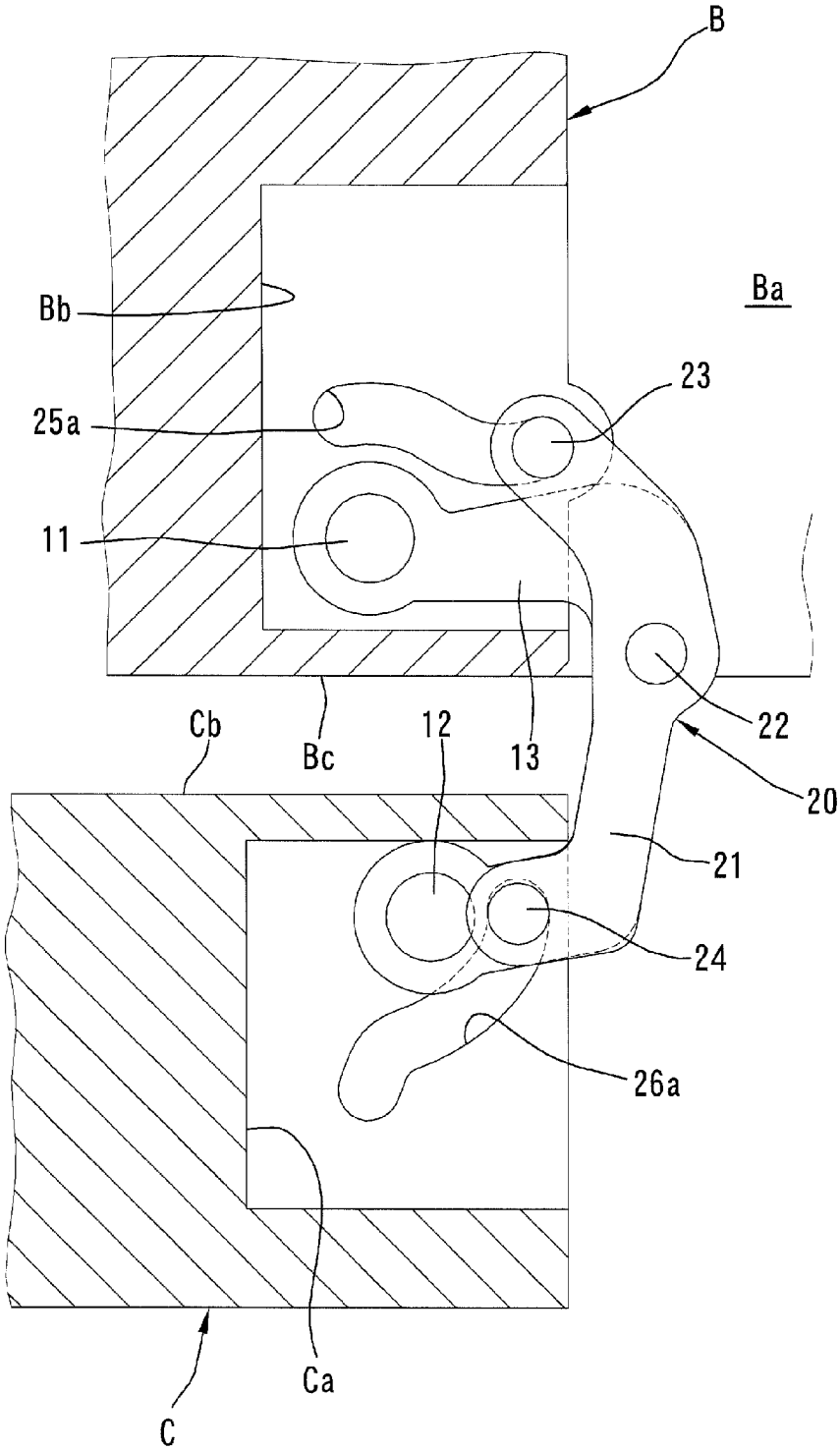
FIG. 11 is a plan view of the rotation control mechanism in a condition when the door is positioned in an open position.

When the door C reaches the open position shown in FIG. 11, the door C is abutted against he connecting arm 13, thereby becoming unable to be rotated further in the opening direction, and stops at the open position. The open position of the door C may be determined by the abutment of the second engagement shaft 24 against the other end portion of the second guide groove 26*a*.

When the door C is to be rotated from the open position toward the closed position, in an initial stage of rotation, the first engagement shaft 23 is engaged with the other end portion (one end portion) of the first guide groove 25*a*, thereby prohibiting the connecting arm 13 from being rotated about the first shaft 11 in a counter-clockwise direction (closing direction; the other direction). Therefore, in the initial stage of the rotation of the door C from the open position toward the closed position, only the door-side mounting member 3 is rotated about the second shaft 12 in the counter-clockwise direction (closing direction) with respect to the connecting arm 13, thereby causing the door C to be rotated toward the closed position. Up to when the door C reaches the second angular position, only the door-side mounting member 3 is rotated.

Figure 8:
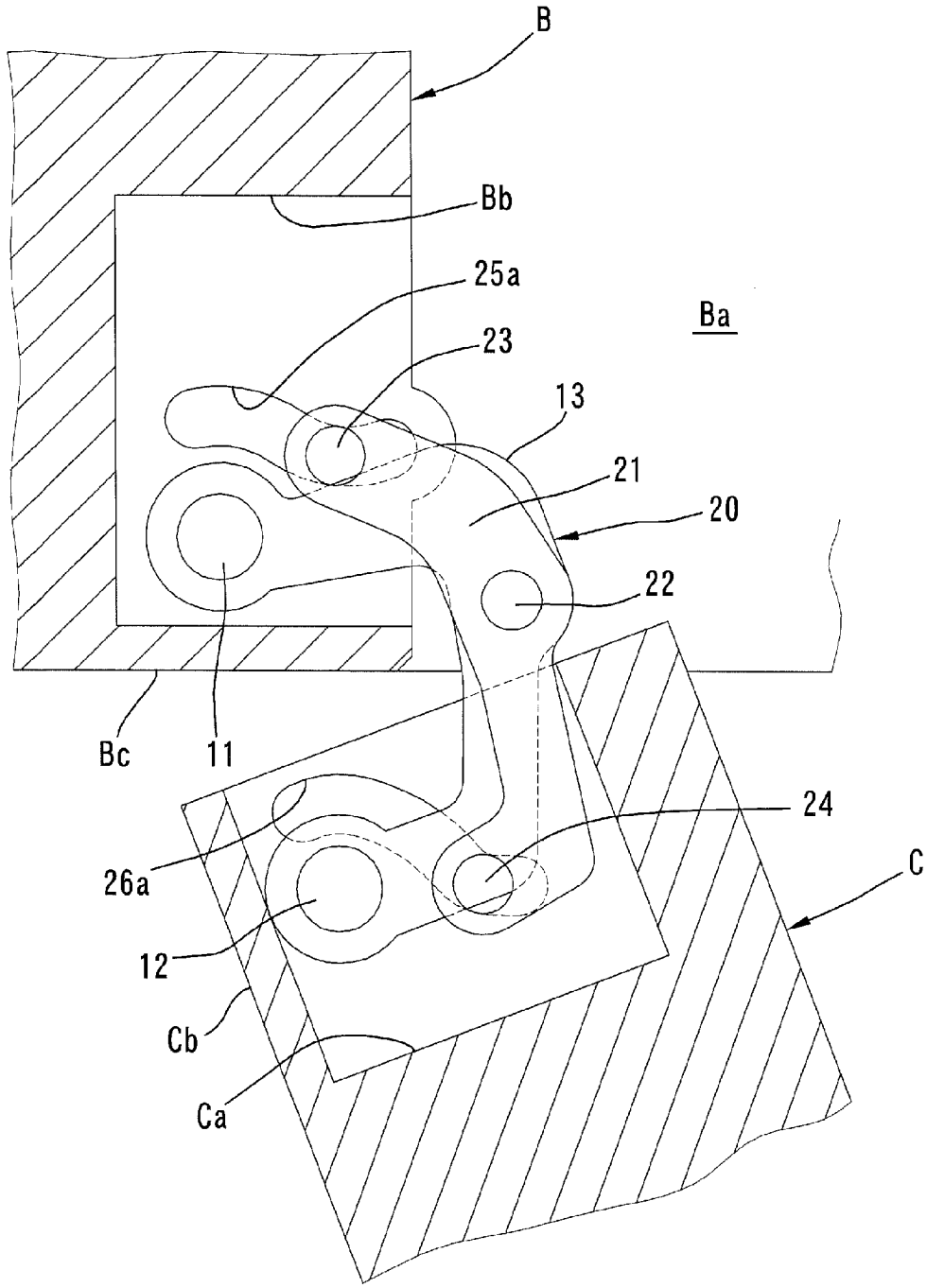
FIG. 8 is a plan view of the rotation control mechanism in a condition when the door is rotated by a predetermined angle that is less than 90 degrees from the closed position toward an open position.

After the door C reaches the second angular position shown in FIG. 10 and before the door C reaches the first angular position, as shown in FIGS. 9 and 8, the engagement of the second engagement shaft 24 and the second guide groove 26*a* causes the swingable member 21 to be rotated about the shaft 22 in the counter-clockwise direction along with the rotation of the door-side mounting member 3 in the opening direction, and accordingly, the connecting arm 13 is rotated about the first shaft 11 in the closing direction. Therefore, when the door C is positioned between the second angular position and the first angular position, the door-side mounting member 3 and the connecting arm 13 are respectively rotated in the closing direction, thereby causing the door C to be rotated in the closing direction.

When the door C reaches the first angular position, engagement of the second engagement shaft 24 with the one end portion of the second guide groove 26*a* prohibits the rotation of the swingable member 21 in the counter-clockwise direction. As a result, the door-side mounting member 3 becomes unable to be rotated in the closing direction with respect to the connecting arm 13, and only the connecting arm 13 is rotated about the first shaft 11 in the closing direction. Along with the rotation of the connecting arm 13, the door C is rotated toward the closed position. When the door C reaches the closed position, the door C is abutted against a stopper (not shown) provided in the frame B. This prohibits the door C from being rotated further in the closing direction. Accordingly, the door is stopped at the closed position.

In the biaxial hinge device A having the above-described features, when the frame-side mounting member 2 is moved in the vertical direction, the connecting arm 13 and the door-side mounting member 3 are moved in the vertical direction following the movement of the frame-side mounting member 2, and consequently, the door C is moved in the vertical direction. Therefore, the position of the door C can be adjusted in the vertical direction by moving the frame-side mounting member 2 an appropriate distance in the vertical direction. Moreover, when the left-right adjustment member 14 is moved in the left-right direction, the first shaft 11 is moved in the left-right direction along with the movement of the left-right adjustment member 14. As a result, the door C is moved in the left-right direction together with the connecting arm 13 and the door-side mounting member 3. Therefore, the position of the door C can be adjusted in the left-right direction by moving the left-right adjustment member 14 an appropriate distance in the left-right direction.

Figure 12:
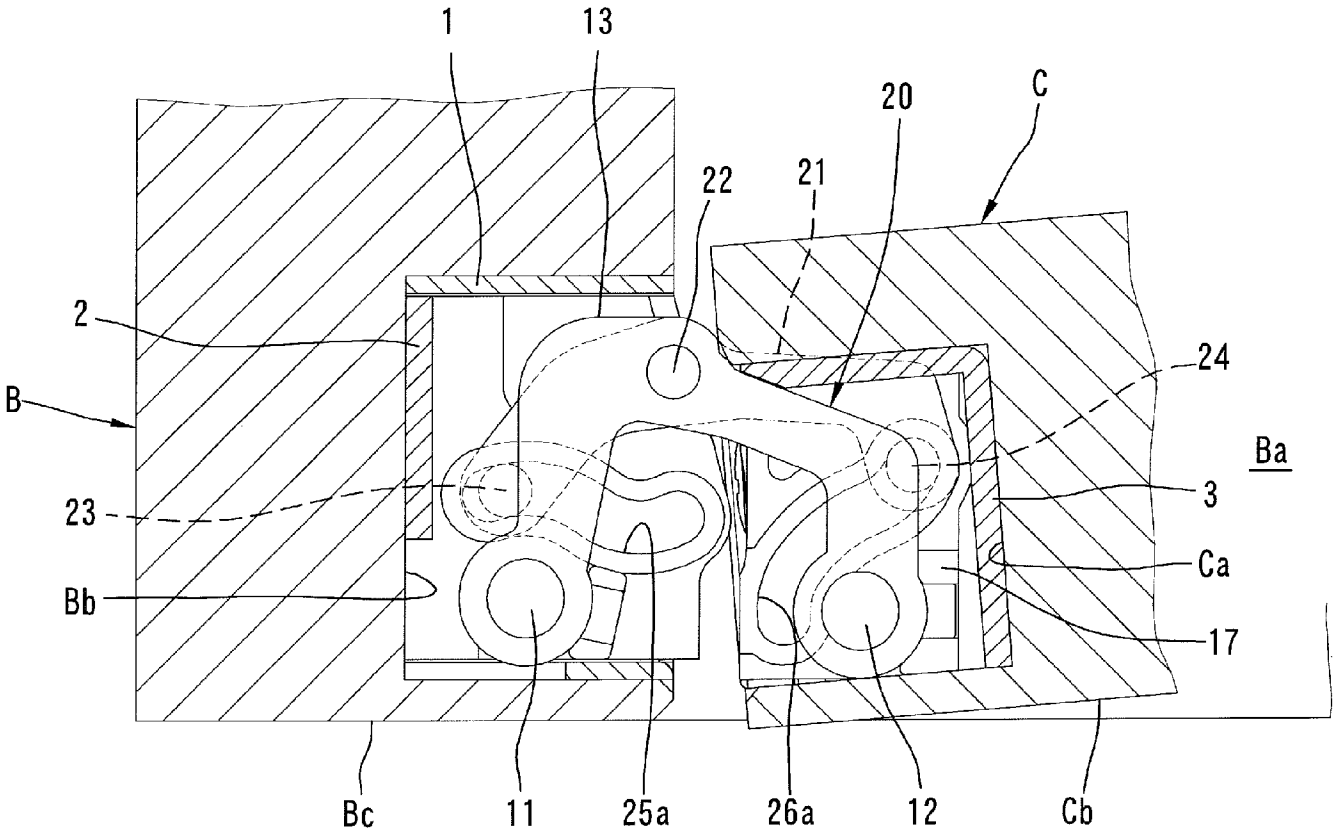
FIG. 12 is a cross-sectional view of the first embodiment of the biaxial hinge device according to the present invention in a condition where the door is rotated by a predetermined angle to adjust the position of the door forward by a predetermined distance.
Figure 13:
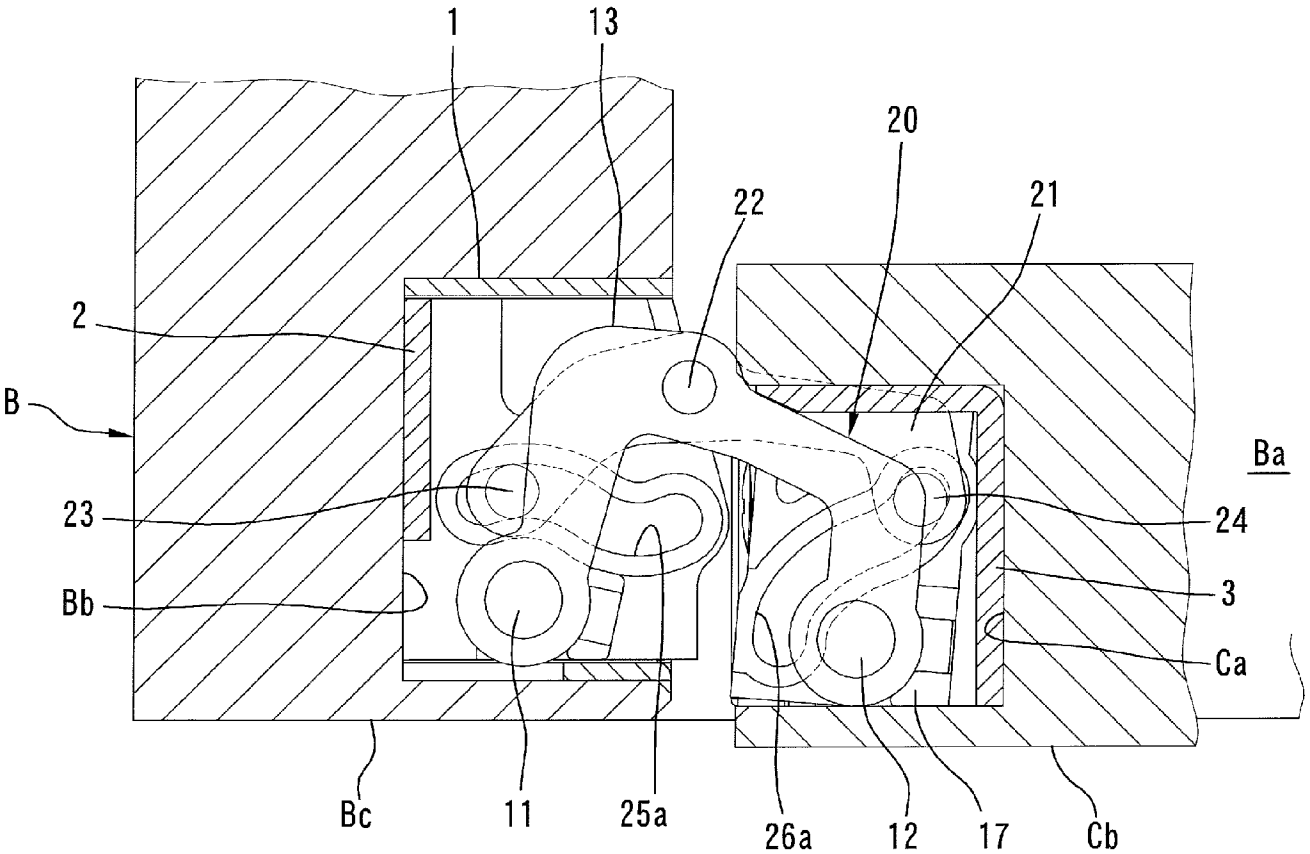
FIG. 13 is a cross-sectional view of the first embodiment of the biaxial hinge device according to the present invention in a condition where the position of the door was adjusted forward by the predetermined distance.

To adjust the position of the door C in the front-rear direction, the adjustment screw 18 is rotated by an appropriate angle in the normal and reverse directions, thereby causing the front-rear adjustment member 17 to be rotated about the second shaft 12 in the normal and reverse directions as appropriate with respect to the door-side mounting member 3. The position adjustment in the front-rear direction mentioned above can be achieved in the following manner, for example. Procedures for adjusting the position of the door C forward will be described first. As shown in FIG. 12, the door C is positioned in the closed position and the rotation of the door-side mounting member 3 with respect to the connecting arm 13 is prohibited by the rotation control mechanism 20. In this condition, the front-rear adjustment member 17 is rotated about the second shaft 12 by an appropriate angle $\alpha$ (several degrees, for example) in the clockwise direction with respect to the door-side mounting member 3. At this time, since the front-rear adjustment member 17 is positioned in the closed position shown in FIG. 7 by the rotation control mechanism 20, actually the door-side mounting member 3 is rotated from the closed position by the angle $\alpha$ further in the closing direction (counter-clockwise direction in FIG. 12). After that, as shown in FIG. 13, the connecting arm 13 is rotated about the first shaft 11 in the clockwise direction (opening direction). The connecting member 13 is rotated until the front surface Cb of the door C becomes parallel to the front surface Bc of the frame B. As a result, the door C is moved forward by a distance corresponding to the angle $\alpha$, thereby the position of the door C is adjusted forward. In other words, when the door C is positioned in the closed position and the front surface Cb of the door C is positioned slightly behind the front surface Bc of the frame B due to some errors, the position of the door C can be adjusted forward by rotating the door C and the door-side mounting member 3 in the counter-clockwise direction (closing direction) with respect to the front-rear adjustment member 17 and then rotating the connecting arm 13 by an angle for canceling out the rotated angle in the opening direction. Thus, the front surface Cb of the door C can be aligned with the front surface Bc of the frame B in the front-rear direction.

Figure 14:
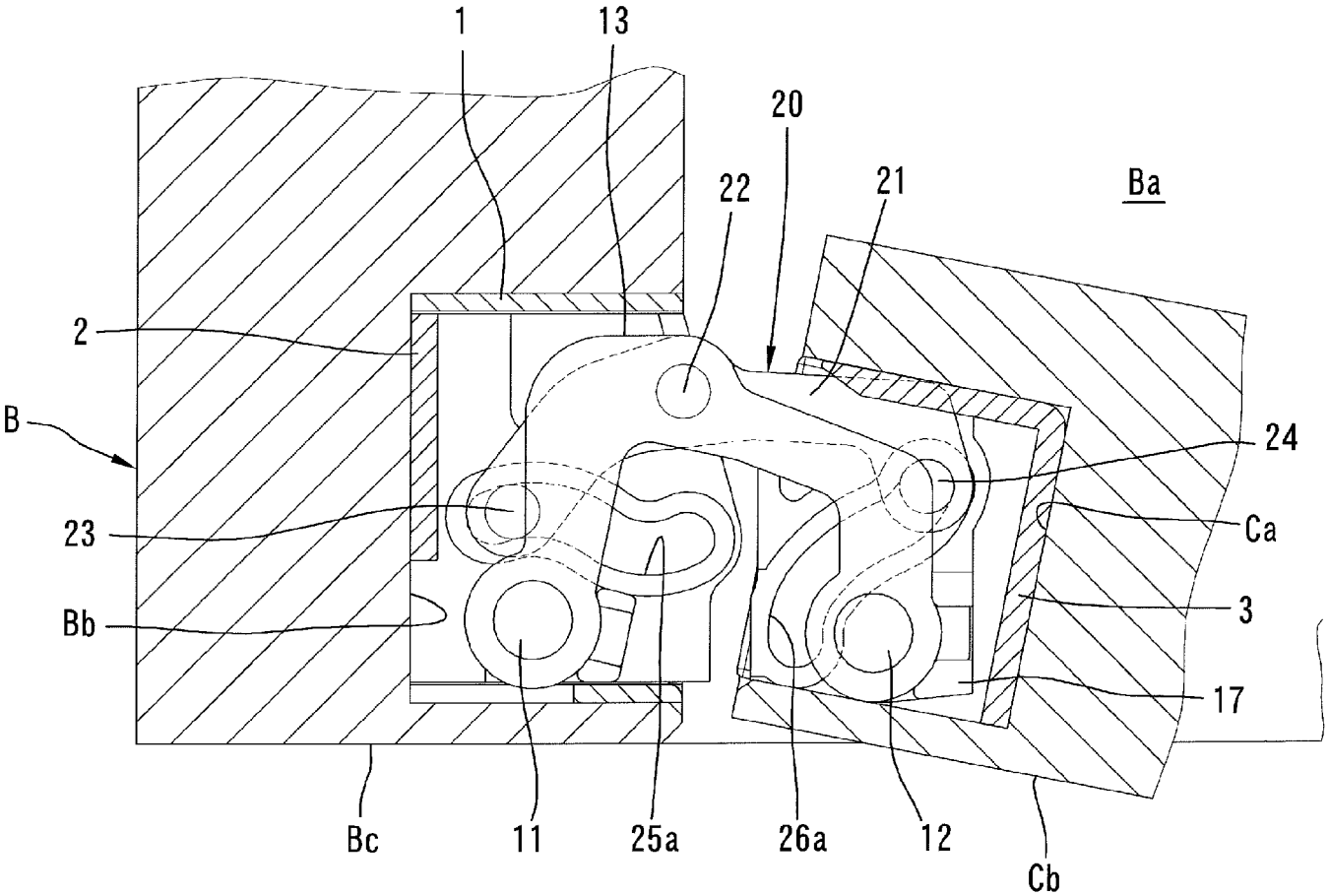
FIG. 14 is a cross-sectional view of the first embodiment of the biaxial hinge device according to the present invention in a condition where the door is rotated by a predetermined angle to adjust the position of the door backward by a predetermined distance.
Figure 15:
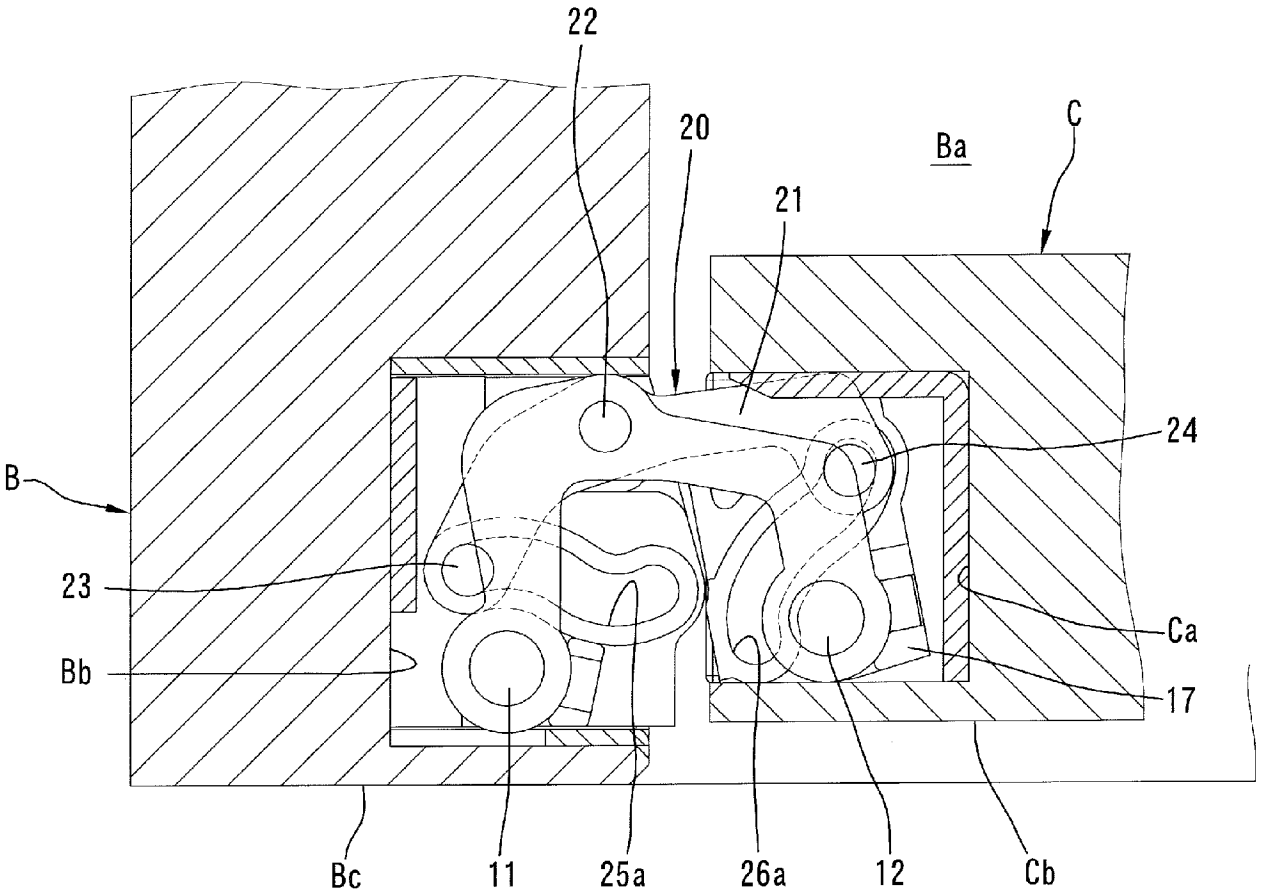
FIG. 15 is a cross-sectional view of the first embodiment of the biaxial hinge device according to the present invention in a condition where the position of the door was adjusted backward by the predetermined distance.
Figure 16:
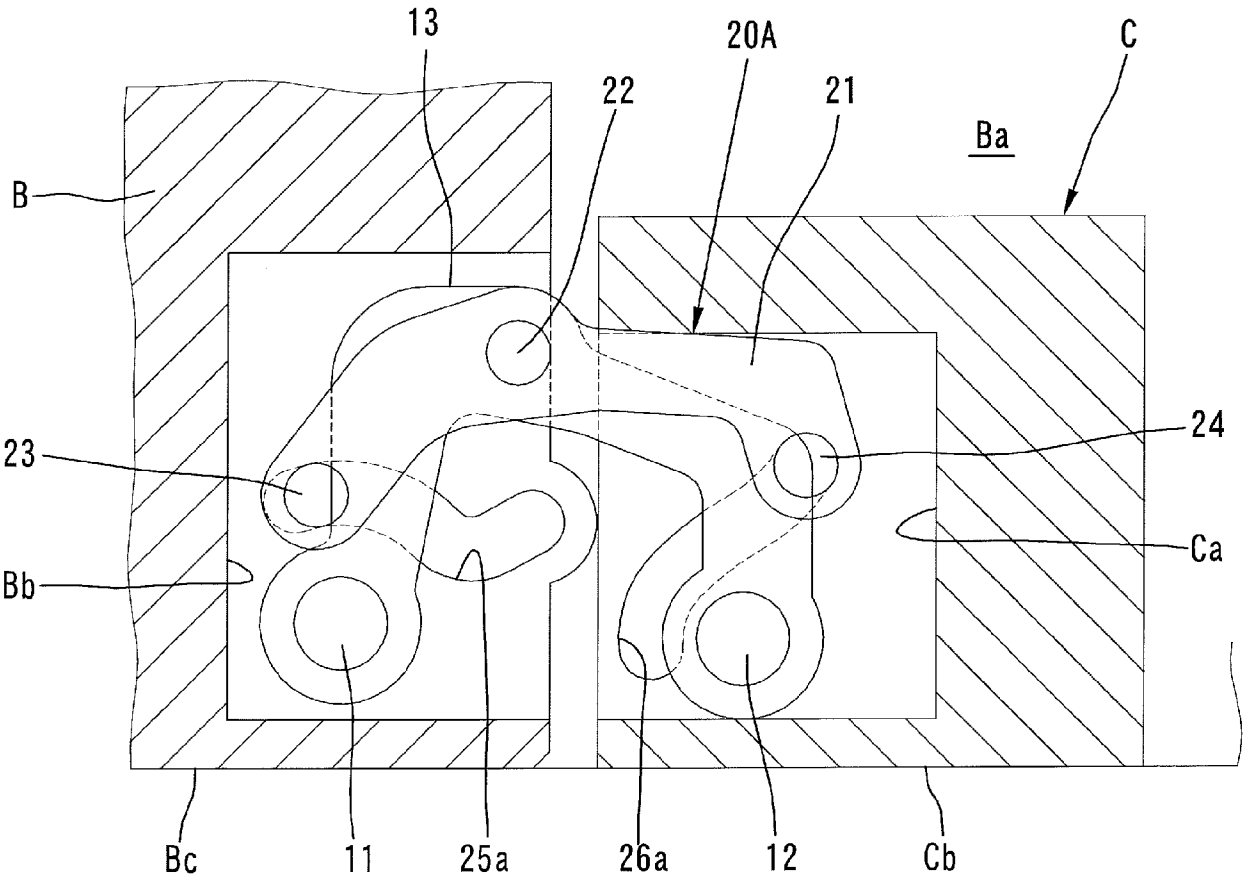
FIG. 16 is a view similar to FIG. 7, showing a second embodiment of a biaxial hinge device according to the present invention.
Figure 17:
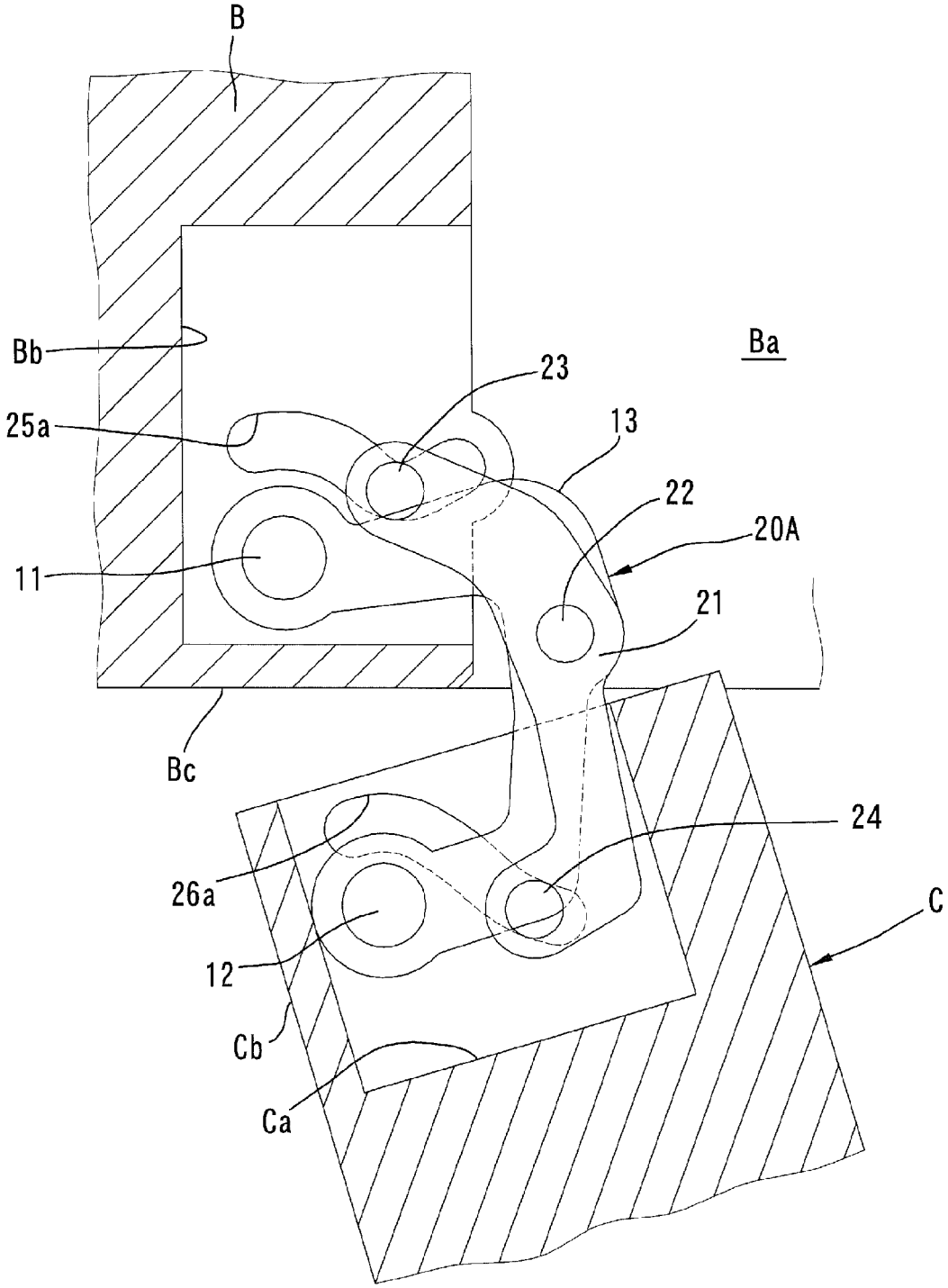
FIG. 17 is a view similar to FIG. 8, showing the second embodiment of the present invention.
Figure 18:
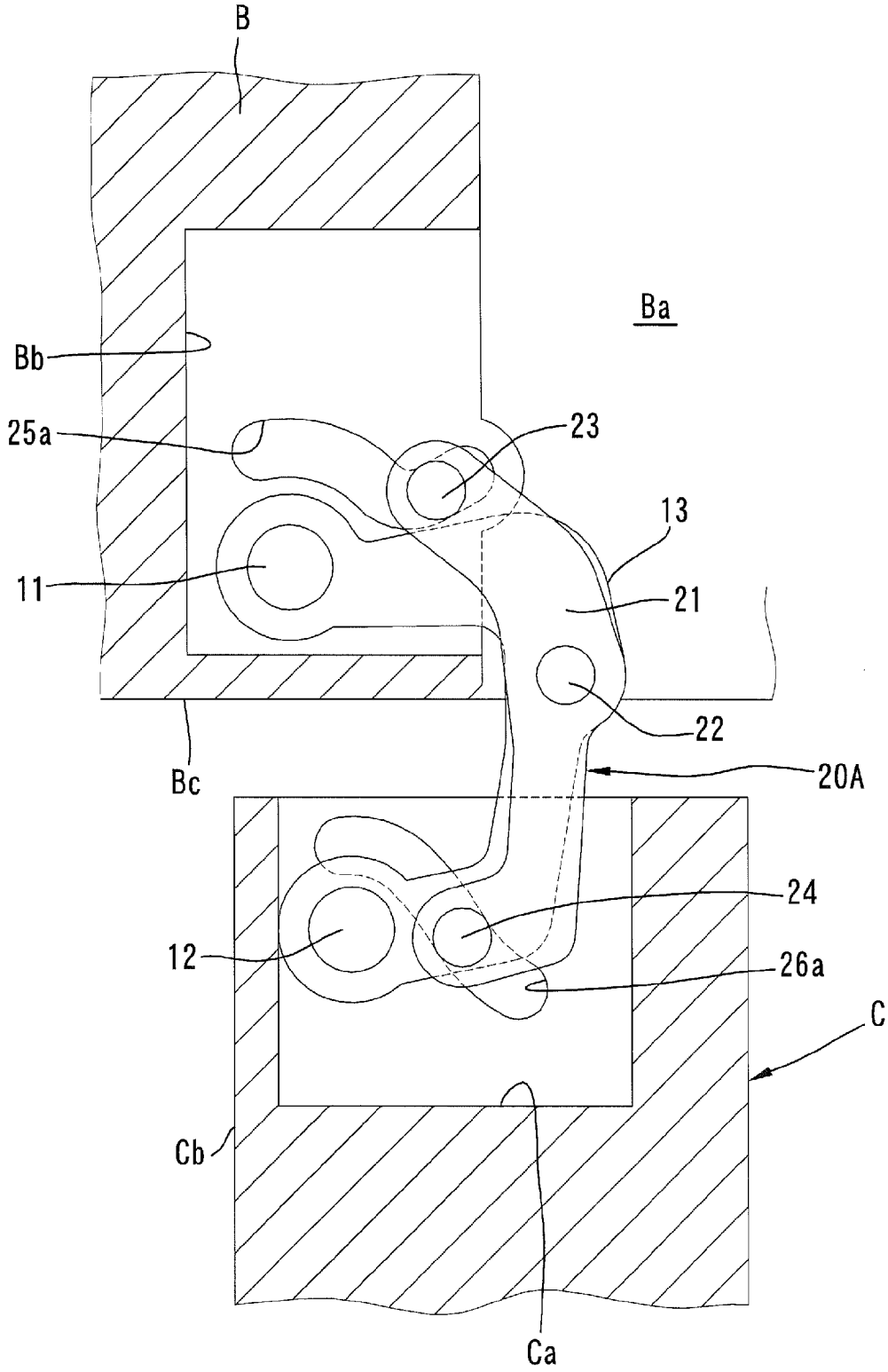
FIG. 18 is a view similar to FIG. 9, showing the second embodiment of the present invention.
Figure 19:
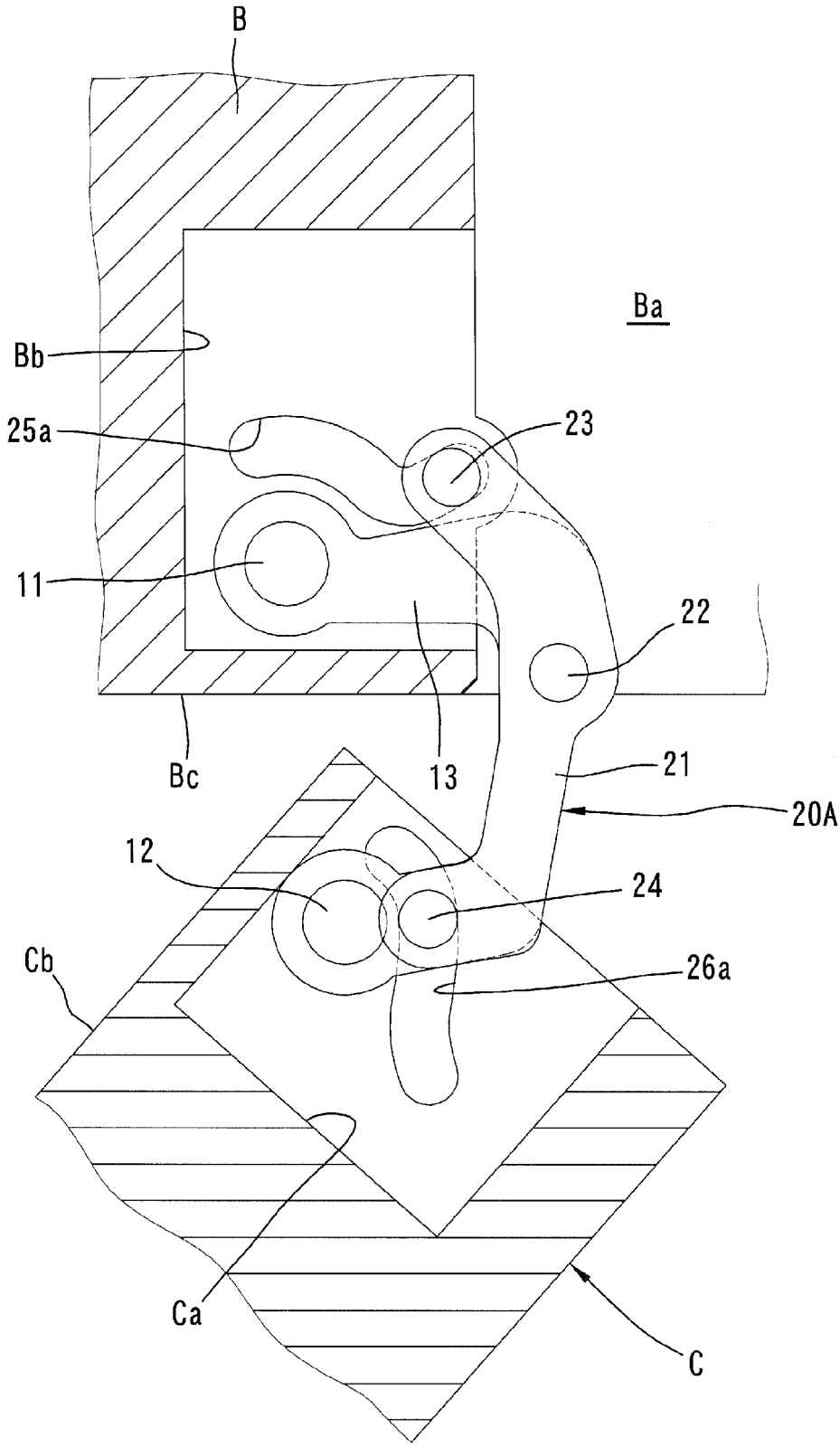
FIG. 19 is a view similar to FIG. 10, showing the second embodiment of the present invention.
Figure 20:
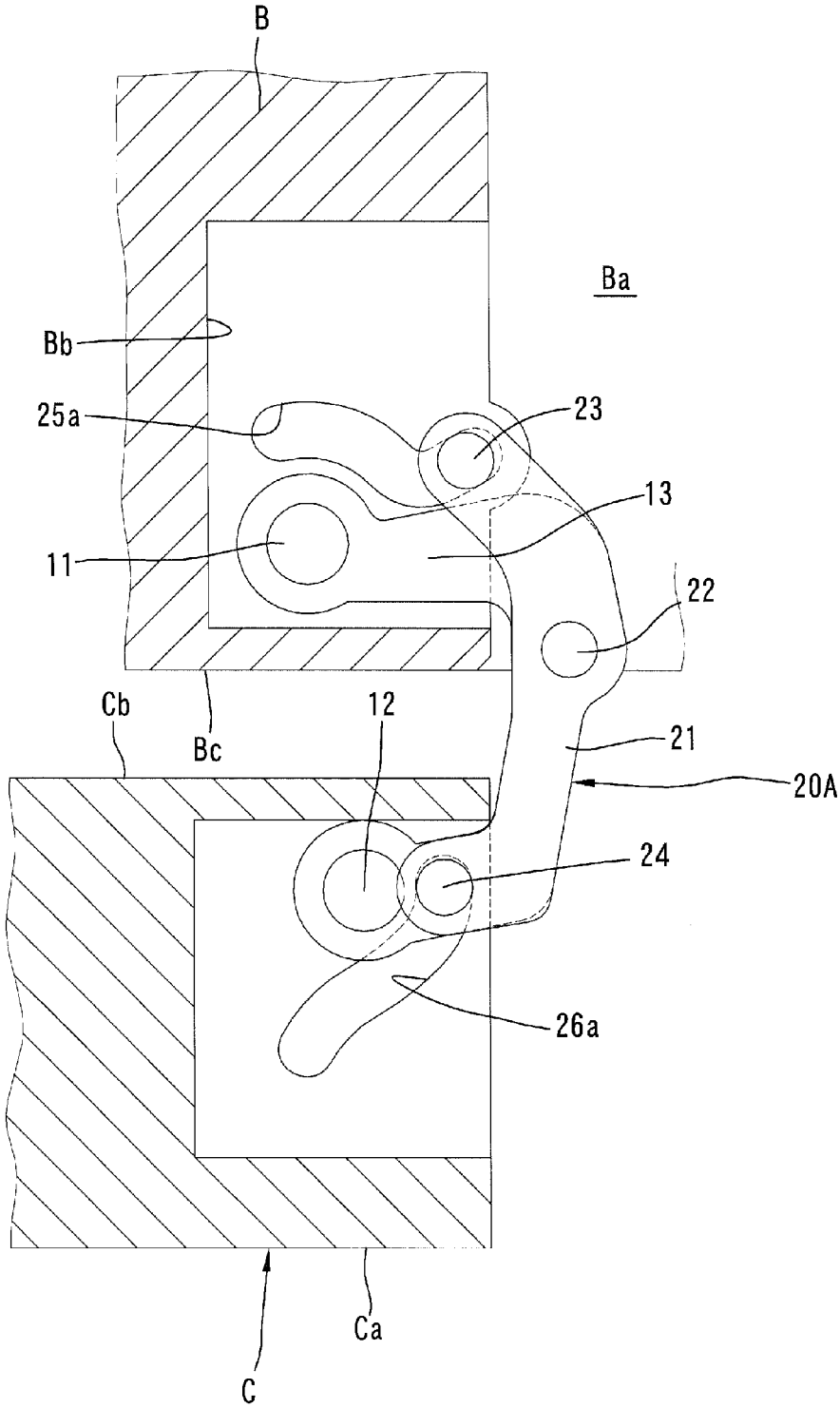
FIG. 20 is a view similar to FIG. 11, showing the second embodiment of the present invention.
Figure 21:
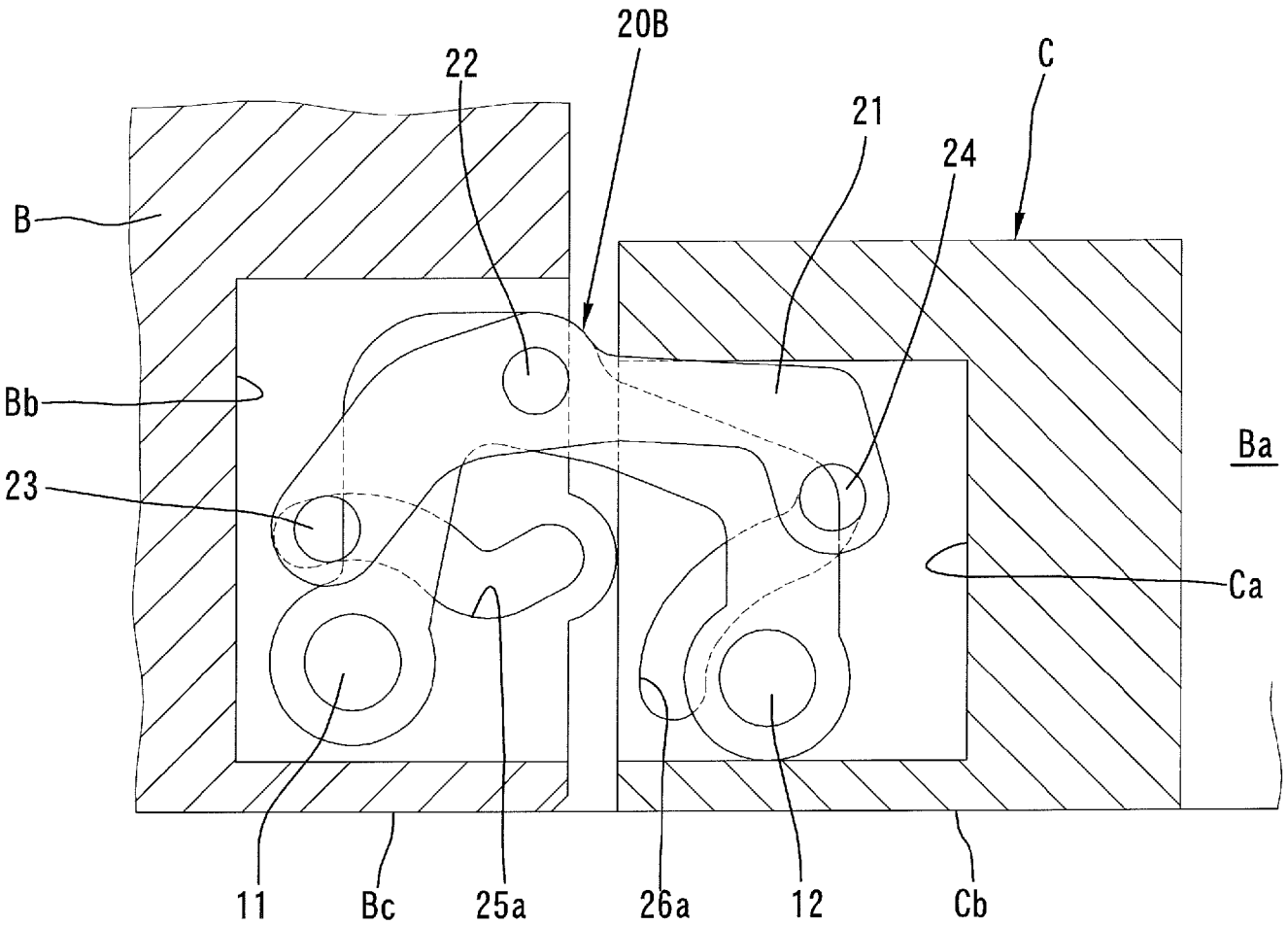
FIG. 21 is a view similar to FIG. 7, showing a third embodiment of a biaxial hinge device according to the present invention.
Figure 22:
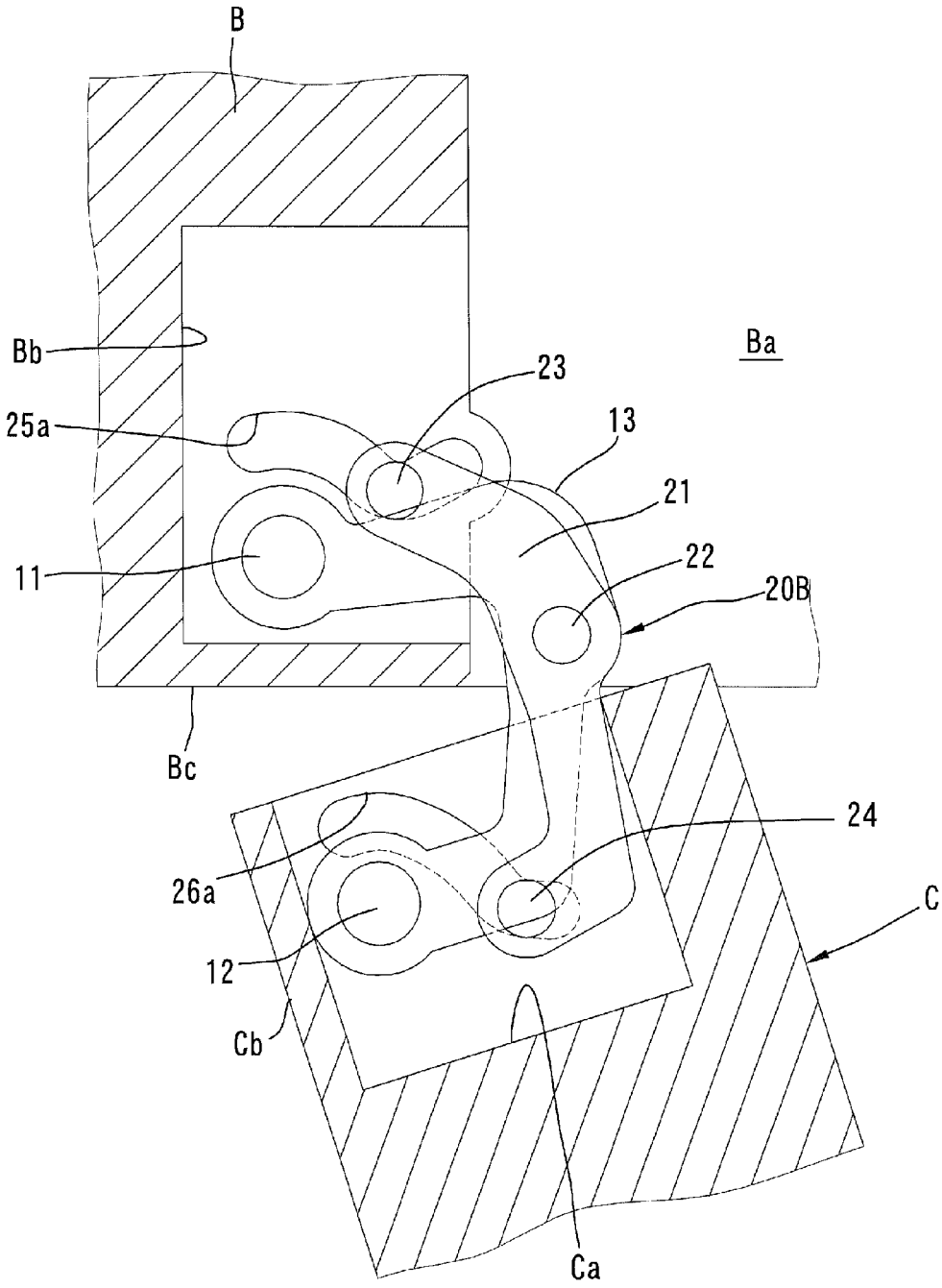
FIG. 22 is a view similar to FIG. 8, showing the third embodiment of the present invention.
Figure 23:
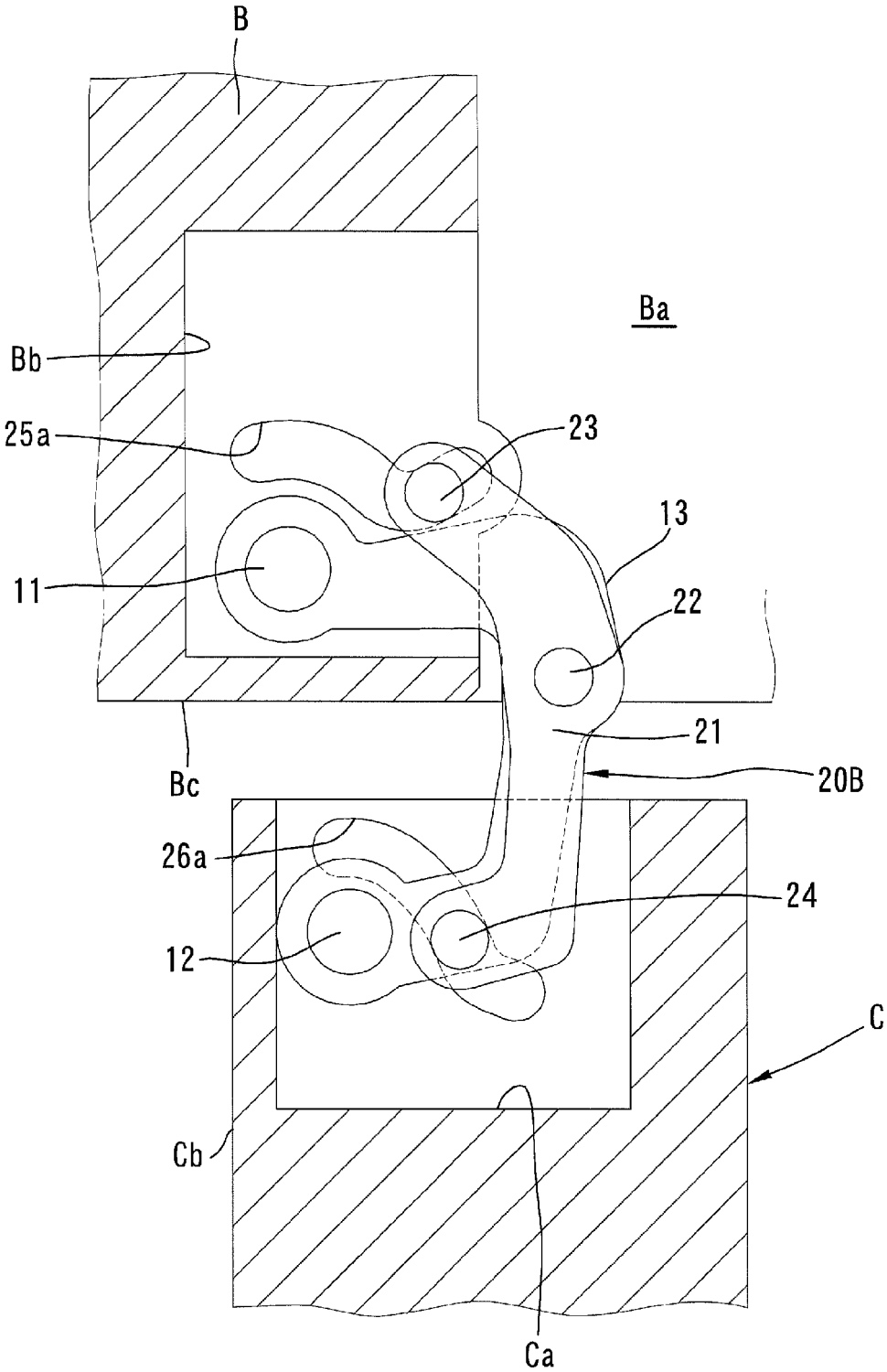
FIG. 23 is a view similar to FIG. 9, showing the third embodiment of the present invention.
Figure 24:
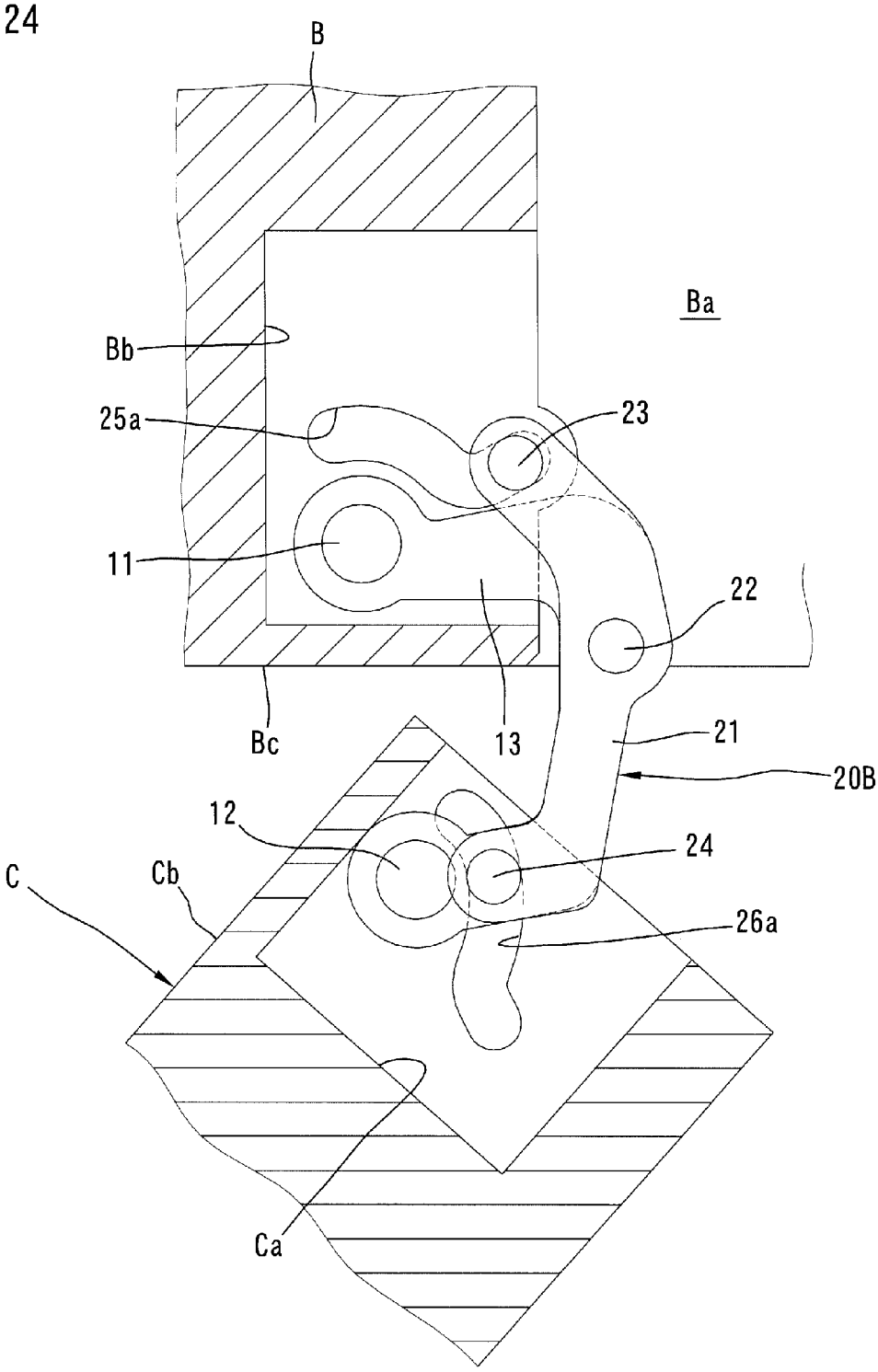
FIG. 24 is a view similar to FIG. 10, showing the third embodiment of the present invention.
Figure 25:
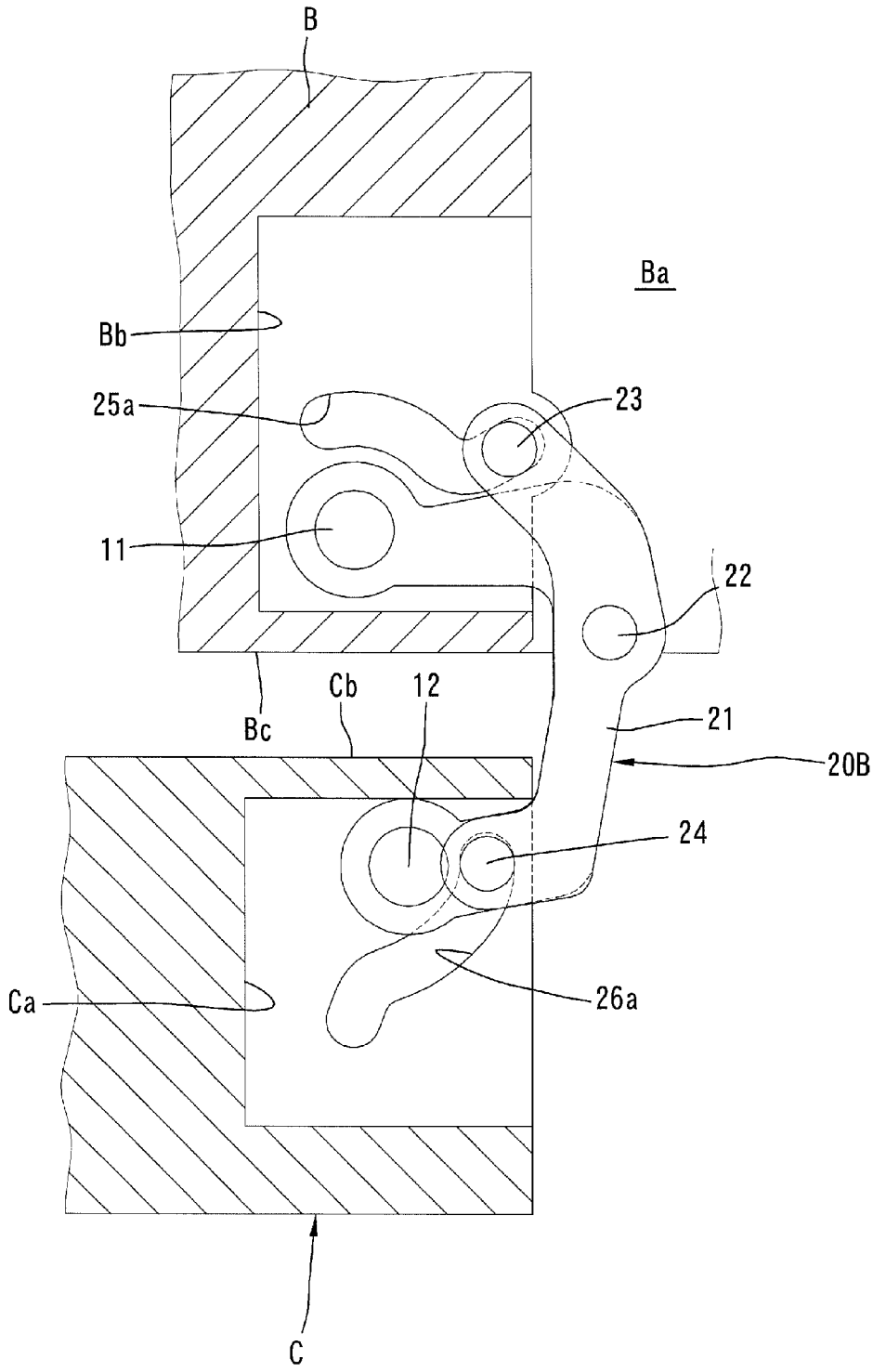
FIG. 25 is a view similar to FIG. 11, showing the third embodiment of the present invention.

FIGS. 14 and 15 show procedures for adjusting the position of the door C backward. In this procedure too, the door C is positioned in the closed position, and the rotation of the front-rear adjustment member 17 with respect to the connecting arm 13 is prohibited by the rotation control mechanism 20. With the door C in that condition, the front-rear adjustment member 17 is rotated about the second shaft 12 in the counter-clockwise direction with respect to the door-side mounting member 3. This causes the door C and the door-side mounting member 3 to be rotated about the second shaft 12 in the clockwise direction with respect to the connecting arm 13. Then, the connecting arm 13 is rotated about the first shaft 11 in the counter-clockwise direction (closing direction) until the front surface Cb of the door C becomes parallel to the front surface Bc of the frame B. The position of the door C can be adjusted backward in this manner.

When the connecting arm 13 is rotated about the first shaft 11 in the counter-clockwise direction, the first engagement shaft 23 is moved in the first guide groove 25*a* from the other end side toward the one end. At this time, if the first engagement shaft 23 is abutted against the one end surface of the first guide groove 25*a*, the first engagement shaft 23 can not be moved toward the one end, and thus the position of the door C can not be adjusted. To avoid this situation, when the door C is positioned in the closed position, the first engagement shaft 23 is slightly spaced from the one end surface of the first guide groove 25*a* toward the other end of the first guide groove 25*a*, thereby allowing the connecting arm 13 to be rotated in the counter-clockwise direction.

In a case where the position of the door C is adjusted in the front-rear direction, all that is necessary is simply to rotate the front-rear adjustment member 17 about the second shaft 12, and it is not necessary to move the front-rear adjustment member 17 in the front-rear direction. Therefore, it is not required to make the door-side mounting member 3 wide or to make the width of the second receiving recess Ca in the front-rear direction correspondingly wide. Therefore, the door C can be prevented from being degraded in strength and in visual quality.

FIGS. 16 to 20 show a second embodiment of the present invention. In this embodiment, a rotation control mechanism 20A is used instead of the rotation control mechanism 20. The rotation control mechanism 20A has an angular range from the closed position to the first angular position (hereinafter referred to as a first angular range) in which only the connecting arm 13 is rotated about the first shaft 11, an angular range from the first angular position to the second angular position (hereinafter referred to as a second angular range) in which the connecting arm 13 is rotated about the first shaft 11 and the door-side mounting member 3 is rotated about the second shaft 12, and an angular range from the second angular position to the open position (hereinafter referred to as a third angular range) in which only the door-side mounting member 3 is rotated about the second shaft 12. The first, the second and the third angular ranges are different from those of the rotation control mechanism 20 of the first embodiment. Namely, the first, second and third angular ranges are respectively set at 0 to 55 degrees, 55 to 128 degrees and 128 to 180 degrees.

FIGS. 21 to 25 show a third embodiment of the present invention. A rotation control mechanism 20B is used in this embodiment. In the rotation control mechanism 20B, the first, second and third angular ranges are respectively set at 0 to 55 degrees, 55 to 128 degrees and 128 to 180 degrees, as with the second embodiment. However, shapes of the first and second guide grooves 25*a*, 26*a* are different from those of the second embodiment.

It is to be understood that the present invention is not limited to the embodiments described above and may be applied to other embodiments without departing from the spirit or scope of the invention.

For example, while the second shaft 12 also serves as a central shaft of the front-rear adjustment member 17 in the embodiments described above, a central shaft of the front-rear adjustment member 17 may be separately provided in addition to the second shaft 12. However, when the second shaft 12 is also used as the central shaft of the front-rear adjustment member, 17, the number of components of the biaxial hinge device A can be reduced, and a manufacturing cost of the biaxial hinge device A can be accordingly reduced. Therefore, it is desirable to use the second shaft 12 also as the central shaft.

Moreover, while the front-rear adjustment member 17 is disposed in the door-side mounting member 3 in the embodiments described above, a front-rear adjustment member (position adjustment member) may be disposed in the frame-side mounting member 2. In this case, the front-rear adjustment member may be disposed so as to be rotatable about the first shaft 11, or may be disposed so as to be rotatable about a central shaft disposed parallel to the first shaft. The front-rear adjustment member is rotated by an adjustment screw that is similar to the adjustment screw 18. When the front-rear adjustment member is disposed in the frame-side mounting member 2, a rotation control mechanism, instead of the rotation control mechanism 20, is provided between the front-rear adjustment member and the door-side mounting member 3 on one side and the connecting arm 13 on the other side. The rotation control mechanism includes the swingable member 21, a first guide groove provided in the front-rear adjustment member and a second guide groove provided in the door-side mounting member 3. The rotation control mechanism is constructed such that when the door C is positioned in the first angular range, the first engagement shaft 23 is positioned at one end portion of the first guide groove, the connecting arm 13 is prohibited from rotating about the first shaft 11, and the second engagement shaft 24 is moved in the second guide groove from the other end side toward the one end of the second guide groove. As a result, the connecting arm 13 is allowed to rotate about the second shaft 12 in the opening direction (one direction). The second engagement shaft 24 is moved in the second guide groove from the one end side toward the other end of the second guide groove. As a result, the connecting arm 13 is allowed to rotate about the second shaft 12 in the closing direction (the other direction). When the door C is positioned in the second angular range, the connecting arm 13 can be rotated about the first shaft 11 and the second shaft 12. When the door C is positioned in the third angular range, the second engagement shaft 24 is positioned at one end portion of the second guide groove, thereby prohibiting the connecting arm 13 from rotating about the second shaft 12, and the first engagement shaft 23 is moved in the first guide groove from the one end side toward the other end of the first guide groove, thereby allowing the connecting arm 13 to be rotated about the first shaft 11 in the opening direction (one direction). The first engagement shaft 23 is moved in the first guide groove from the other end side toward the one end of the first guide groove, allowing the connecting arm 13 to rotate about the first shaft 11 in the closing direction (the other direction).

To adjust the position of the door C in the front-rear direction in a biaxial hinge device having the above mentioned features, the front-rear adjustment member is rotated about the first shaft 11 by an appropriate angle, and then the door-side mounting member 3 is rotated about the second shaft 12 by an angle for canceling out the angle by which the front-rear adjustment member was rotated. Also in this case, it is desirable to make the other end surface of the second guide groove spaced from the second engagement shaft 24 by a predetermined distance and to make the connecting arm 13 rotatable in the closing direction (the other direction) by an angle corresponding to the distance when the door C is positioned in the closed position such that the position of the door C can be adjusted backward.

While the second angular range in which the connecting arm 13 is rotatable about the first shaft 11 and at the same time rotatable about the second shaft 12 is provided in the embodiments described above, the second angular range may be omitted. More specifically, as described in the Patent Document 1 given above, an arrangement may be made such that when the connecting arm 13 is rotatable about the first shaft 11, the connecting arm 13 is prohibited from being rotated about the second shaft 12, and when the connecting arm 13 is rotatable about the second shaft 12, the connecting arm 13 is prohibited from being rotated about the first shaft 13, thereby prohibiting the connecting arm 13 from being rotated about the first shaft 11 and the second shaft 12 at the same time.

INDUSTRIAL APPLICABILITY

The biaxial hinge device according to the present invention may be used between a frame of a body and a door for opening and closing an opening of the frame, and may particularly be used as a concealed hinge device that can hardly be visible from outside when the door is closed.

REFERENCE SINGS LIST

A biaxial hinge device
B frame
C door
2 frame-side mounting member
3 door-side mounting member
11 first shaft
12 second shaft
13 connecting arm
17 front-rear adjustment member (position adjustment member)
18 adjustment screw (rotational position adjustment mechanism)
20 rotation control mechanism
20A rotation control mechanism
20B rotation control mechanism
21 swingable member (engagement member)
22 shaft
23 first engagement shaft (one end portion of the engagement member)
24 second engagement shaft (the other end portion of the engagement member)
25*a* first guide groove
26*a* second guide groove

The invention claimed is:

1. A biaxial hinge device comprising:

a frame-side mounting member to be mounted to a frame;

a door-side mounting member to be mounted to a door;

a connecting arm, one end portion of the connecting arm rotatably connected to the frame-side mounting member via a first shaft, the other end portion of the connecting arm rotatably connected to the door-side mounting member via a second shaft disposed parallel to the first shaft; and a rotation control mechanism, the rotation control mechanism allowing the connecting arm to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft;

the door-side mounting member being rotated with respect to the frame-side mounting member between a closed position and an open position by the rotation of the connecting arm about the first shaft and the second shaft, wherein a position adjustment member is disposed in the door-side mounting member such that the position adjustment member is rotatable about a central shaft, the central shaft being one of the second shaft and a shaft disposed parallel to the second shaft;

a rotational position adjustment mechanism is disposed between the door-side mounting member and the position adjustment member, the rotational position adjustment mechanism adjusting rotational position of the position adjustment member about the central shaft; and, the rotation control mechanism is disposed between the frame-side mounting member and the position adjustment member on one side and the connecting arm on the other side.

2. The biaxial hinge device according to claim 1, wherein the second shaft also serves as the central shaft.

3. The biaxial hinge device according to claim 2, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the frame-side mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove;

when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

4. The biaxial hinge device according to claim 3, wherein when the door-side mounting member is positioned in the closed position, the other end portion of the engagement member is engaged with the second guide groove, the connecting arm being prohibited from rotating about the second shaft, the one end portion of the engagement member is positioned in the other end portion of the first guide groove so that the connecting arm can be rotated about the first shaft in one direction, the other end surface of the first guide groove is spaced from the one end portion of the engagement member by a predetermined distance, and the connecting arm is rotatable about the first shaft in the other direction by an angle corresponding to the distance by which the other end surface of the first guide groove is spaced from the one end portion of the engagement member.

5. The biaxial hinge device according to claim 1, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the frame-side mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove;

when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

6. The biaxial hinge device according to claim 5, wherein when the door-side mounting member is positioned in the closed position, the other end portion of the engagement member is engaged with the second guide groove, the connecting arm being prohibited from rotating about the second shaft, the one end portion of the engagement member is positioned in the other end portion of the first guide groove so that the connecting arm can be rotated about the first shaft in one direction, the other end surface of the first guide groove is spaced from the one end portion of the engagement member by a predetermined distance, and the connecting arm is rotatable about the first shaft in the other direction by an angle corresponding to the distance by which the other end surface of the first guide groove is spaced from the one end portion of the engagement member.

7. A biaxial hinge device comprising:

a frame-side mounting member to be mounted to a frame;

a door-side mounting member to be mounted to a door;

a connecting arm, one end portion of the connecting arm rotatably connected to the frame-side mounting member via a first shaft, the other end portion of the connecting arm rotatably connected to the door-side mounting member via a second shaft disposed parallel to the first shaft; and a rotation control mechanism, the rotation control mechanism allowing the connecting aim to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft;

the door-side mounting member being rotated with respect to the frame-side mounting member between a first rotational position and a second rotational position by the rotation of the connecting arm about the first shaft and the second shaft, wherein a position adjustment member is disposed in the frame-side mounting member such that the position adjustment member is rotatable about a central shaft, the central shaft being one of the first shaft and a shaft disposed parallel to the first shaft;

a rotational position adjustment mechanism is disposed between the frame-side mounting member and the position adjustment member, the rotational position adjustment mechanism adjusting rotational position of the position adjustment member about the central shaft; and, the rotation control mechanism is disposed between the door-side mounting member and the position adjustment member on one side and the connecting arm on the other side.

8. The biaxial hinge device according to claim 7, wherein the first shaft also serves as the central shaft.

9. The biaxial hinge device according to claim 8, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the position adjustment member, one end portion of the engagement member being engaged with the first guide groove such that the one end portion of the engagement member is movable in a longitudinal direction of the first guide groove, the second guide groove being disposed in the door-side mounting member, the other end portion of the engagement member being engaged with the second guide groove such that the other end portion of the engagement member is movable in a longitudinal direction of the second guide groove;

when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft; and, when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft.

10. The biaxial hinge device according to claim 9, wherein when the door-side mounting member is positioned in the closed position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

11. The biaxial hinge device according to claim 7, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the position adjustment member, one end portion of the engagement member being engaged with the first guide groove such that the one end portion of the engagement member is movable in a longitudinal direction of the first guide groove, the second guide groove being disposed in the door-side mounting member, the other end portion of the engagement member being engaged with the second guide groove such that the other end portion of the engagement member is movable in a longitudinal direction of the second guide groove;

when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft; and, when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft.

12. The biaxial hinge device according to claim 11, wherein when the door-side mounting member is positioned in the closed position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

13. A biaxial hinge device comprising:

a first mounting member;

a second mounting member;

a connecting arm, one end portion of the connecting arm connected to the first mounting member such that the connecting arm is rotatable about a first shaft, the other end portion of the connecting arm connected to the second mounting member such that the connecting arm is rotatable about a second shaft disposed parallel to the first shaft; and a rotation control mechanism, the rotation control mechanism allowing the connecting arm to be rotated about the second shaft when the rotation control mechanism prohibits the connecting arm from being rotated about the first shaft, the rotation control mechanism allowing the connecting arm to be rotated about the first shaft when the rotation control mechanism prohibits the connecting arm from being rotated about the second shaft;

the second mounting member being rotated with respect to the first mounting member between a first rotational position and a second rotational position by the rotation of the connecting arm about the first shaft and the second shaft, wherein a position adjustment member is disposed in the second mounting member such that the position adjustment member is rotatable about a central shaft, the central shaft being one of the second shaft and a shaft disposed parallel to the second shaft;

a rotational position adjustment mechanism is disposed between the second mounting member and the position adjustment member, the rotational position adjustment mechanism adjusting a rotational position of the position adjustment member with respect to the second mounting member; and, the rotation control mechanism is disposed between the first mounting member and the position adjustment member on one side and the connecting arm on the other side.

14. The biaxial hinge device according to claim 13, wherein the second shaft also serves as the central shaft.

15. The biaxial hinge device according to claim 14, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the first mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove;

when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

16. The biaxial hinge device according to claim 15, wherein when the second mounting member is positioned in the first rotational position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

17. The biaxial hinge device according to claim 13, wherein the rotation control mechanism comprises an engagement member, a first guide groove and a second guide groove, a middle portion of the engagement member being disposed in the connecting arm such that the engagement member is rotatable about a shaft disposed parallel to the first shaft and the second shaft, the first guide groove being disposed in the first mounting member, one end portion of the engagement member being engaged with the first guide groove such that the one end portion of the engagement member is movable in a longitudinal direction of the first guide groove, the second guide groove being disposed in the position adjustment member, the other end portion of the engagement member being engaged with the second guide groove such that the other end portion of the engagement member is movable in a longitudinal direction of the second guide groove;

when the connecting arm is prohibited from being rotated about the second shaft by the engagement of the other end portion of the engagement member with the second guide groove, the one end portion of the engagement member is moved in the first guide groove in the longitudinal direction of the first guide groove, the connecting arm being allowed to rotate about the first shaft; and, when the connecting arm is prohibited from being rotated about the first shaft by the engagement of the one end portion of the engagement member with the first guide groove, the other end portion of the engagement member is moved in the second guide groove in the longitudinal direction of the second guide groove, the connecting arm being allowed to rotate about the second shaft.

18. The biaxial hinge device according to claim 17, wherein when the second mounting member is positioned in the first rotational position, the one end portion of the engagement member is engaged with the first guide groove, the connecting arm being prohibited from rotating about the first shaft, the other end portion of the engagement member is positioned in the other end portion of the second guide groove so that the connecting arm can be rotated about the second shaft in one direction, the other end surface of the second guide groove is spaced from the other end portion of the engagement member by a predetermined distance, and the connecting arm is rotatable about the second shaft in the other direction by an angle corresponding to the distance by which the other end surface of the second guide groove is spaced from the other end portion of the engagement member.

* * * * *